United States Patent [19]

Murakami et al.

[11] Patent Number: 4,917,366

[45] Date of Patent: Apr. 17, 1990

[54] SHEET HANDLING APPARATUS

[75] Inventors: Koichi Murakami, Yokohama; Hideki Adachi, Kawasaki; Masanori Miyata, Yokohama; Takeshi Honjo, Kawasaki, all of Japan

[73] Assignee: Canon Kabushiki Kaisha, Tokyo, Japan

[21] Appl. No.: 16,867

[22] Filed: Feb. 20, 1987

[30] Foreign Application Priority Data

| | | | |
|---|---|---|---|
| Feb. 25, 1986 | [JP] | Japan | 61-38322 |
| Feb. 25, 1986 | [JP] | Japan | 61-38323 |
| Feb. 25, 1986 | [JP] | Japan | 61-38324 |
| Feb. 25, 1986 | [JP] | Japan | 61-38325 |
| Feb. 25, 1986 | [JP] | Japan | 61-38326 |
| Feb. 25, 1986 | [JP] | Japan | 61-38327 |
| Apr. 11, 1986 | [JP] | Japan | 61-82303 |
| Apr. 11, 1986 | [JP] | Japan | 61-82304 |
| Apr. 11, 1986 | [JP] | Japan | 61-82305 |
| Apr. 11, 1986 | [JP] | Japan | 61-82306 |
| Apr. 11, 1986 | [JP] | Japan | 61-82307 |
| Apr. 11, 1986 | [JP] | Japan | 61-82310 |
| Jun. 9, 1986 | [JP] | Japan | 61-133566 |
| Jun. 9, 1986 | [JP] | Japan | 61-133568 |
| Jun. 9, 1986 | [JP] | Japan | 61-133576 |
| Jun. 9, 1986 | [JP] | Japan | 61-133577 |
| Jun. 9, 1986 | [JP] | Japan | 61-133578 |
| Jun. 9, 1986 | [JP] | Japan | 61-133579 |

[51] Int. Cl.[4] ..... B42B 1/02

[52] U.S. Cl. ..... 270/53; 270/37; 270/58; 227/7; 493/421

[58] Field of Search ..... 270/37, 53, 56, 58; 227/1, 7; 412/11, 12; 493/16, 12, 420, 421; 209/546, 656, 659, 606; 355/13 SH, 14 CH, 14 R, 308, 309, 313, 321, 324

[56] References Cited

U.S. PATENT DOCUMENTS

| | | | |
|---|---|---|---|
| 3,685,712 | 8/1972 | Turner et al. | 227/3 |
| 4,134,672 | 1/1979 | Burlew et al. | 270/58 |
| 4,190,246 | 2/1980 | Sosuga | 271/9 |
| 4,361,393 | 11/1982 | Noto | 270/58 |
| 4,424,963 | 1/1984 | Bartholet et al. | 270/53 |
| 4,509,732 | 4/1985 | Kanno et al. | 270/37 |
| 4,566,782 | 1/1986 | Britt et al. | 270/53 |
| 4,575,296 | 3/1986 | Kockler et al. | 270/53 |
| 4,579,328 | 2/1986 | Hagihara et al. | 271/9 |
| 4,603,971 | 8/1986 | Kukucka et al. | 270/53 |
| 4,605,211 | 8/1986 | Sonobe | 270/53 |
| 4,626,156 | 12/1986 | Baughman | 412/33 |
| 4,711,556 | 12/1987 | Abuyama | 355/14 CU |

FOREIGN PATENT DOCUMENTS

| | | |
|---|---|---|
| 2911290 | 11/1979 | Fed. Rep. of Germany . |
| 3006936 | 8/1980 | Fed. Rep. of Germany . |
| 2020596 | 5/1979 | United Kingdom . |

*Primary Examiner*—Randall L. Green
*Assistant Examiner*—Therese Newholm
*Attorney, Agent, or Firm*—Fitzpatrick, Cella, Harper & Scinto

[57] ABSTRACT

There is disclosed a sheet handling apparatus capable of stapling discharged for example from a copying machine in which stapling operation is prohibited in certain cases, for example if the desired copy consists of one page only, or if the sheet folding is conducted defectively.

45 Claims, 33 Drawing Sheets

SHEET HANDLING APPARATUS

BACKGROUND OF THE INVENTION

1. Field of the Invention

The present invention relates to an apparatus for handling sheet materials, and more particularly to a sheet handling apparatus for effecting certain specified processes such as folding or stapling on sheets fed from a recording apparatus such as a copying or printing apparatus.

2. Related Background Art

There is already proposed a copying machine or a printing apparatus with stapling function for binding sheets by driving a staple, or a U-shaped metal strip, into the sheets.

Such stapling function is convenient for the users as the image recording and document binding are achieved at the same time.

In a sheet handling apparatus, such as a copying machine, with such stapling function, it is customary to employ a recycling document feeder (RDF) (also called recycling document handler (RDH)) and to effect the stapling each time when a recycling of the sheets on the RDF is detected.

However such stapling operation cannot be effected in case of automatic sheet-by-sheet feeding, because it is difficult to identify the completion of copying operation on all the documents.

Also in the above-mentioned sheet handling apparatus, the stapling operation is not possible or required complex procedure in case of the book copying mode in which the RDF or automatic document feeder (ADF) is not used, although such copying mode is often used. Also if the stapling mode is erroneously selected in case of a single copying, the obtained copy is usually stapled though it is in fact unnecessary.

Also in such apparatus, if the stapling function is selected when a sheet cassette of an irregular size or a manual sheet feeding is designated, the image recording or copying operation becomes prohibited, thus causing a trouble for the user.

Certain copying machines have an interruption copy mode in which a continuous copying operation can be interrupted for starting a copying operation of another mode, but such interruption copy mode is prohibited during the stapling operation, and such apparatus is therefore inconvenient for the users.

Also certain copying machines have an automatic paper selection (APS) function of detecting the original size and selecting a copy sheet according to the detected size. On the other hand, the stapling mode has a limitation that it is applicable only to the recording sheets of a same size. Thus, if a recording sheet not matching said limitation is selected for example from a cassette during the stapling mode, the entire apparatus has to be stopped. Thus the image recording itself is interrupted, and the mode setting has to be made anew after the staple mode is cancelled.

Also in the normal status, the stapling operation is conducted in response to the detection of the end of original documents on the RDF etc. as explained before. If necessary, the operator may interrupt the recording operation by actuating a stop key, but there will result an inconvenience in such case that the discharged copy sheets cannot be stapled.

Also in such apparatus there is already known a structure equipped with a staple tray for stacking sheets for stapling, and a stack tray for receiving stapled bundles of sheets.

However, in transporting a stapled sheet bundle from the staple tray to the stack tray, the stapled bundle is often not neatly placed on other sheet bundles already contained in the stack tray, or an uppermost sheet is disengaged from the staples, according to the size or the number of sheets in the bundle.

Furthermore, in such apparatus, the stapling mode may not provide the user with the desired set of copies but produce miscopies, to the disadvantage of the user, if the copies are made irrespective of the number of originals or preset copy number-and are unconditionally stapled.

Furthermore, in such apparatus, the succeeding image recording operation is prohibited during the stapling operation, and such prohibition may reduce the throughput of the entire recording operation.

Furthermore, in such apparatus, the stapling operation is conducted on the sheets stacked, after recording, on tray means provided in the apparatus. Thus, if the operator leaves some recording sheets on said tray and the next operator initiates a stapling operation utilizing the original feeding means and without removing such remaining sheets, such remaining sheets may be mixed in the sheets obtained in the succeeding operation.

Furthermore, in such apparatus, the operator can usually select a sorting mode or a grouping mode in which copies obtained from a same original are grouped, regardless whether the stapling mode is selected or not. However if the grouping mode is erroneously designated in combination with the stapling mode, the copies from a same original are stapled. This is apparently different from the properly collated copies which the user wishes. In this manner the conventional apparatus are difficult to operate and tend to provide erroneous copies.

Furthermore, in such apparatus, the stapling function is activated only when the sorting mode or the grouping mode is selected.

There are also already known certain apparatus capable of stapling function and folding function. Such folding function is usually achieved by a pair of folding rollers and by inserting a looped recording sheet into the nip of said folding rollers.

However the sheet handling apparatus with such folding mechanism may generate improper folding due to wrinkles in the sheet, skewed movement thereof, or dust or scars on the folding rollers, thus eventually leading a sheet jam in the downstream path. Even if such sheet jam does not occur, such improperly folded sheets, if stapled in such state, may require restapling or refolding.

SUMMARY OF THE INVENTION

In consideration of the foregoing, an object of the present invention is to provide an improved sheet handling apparatus.

Another object of the present invention is to provide a sheet handling apparatus with improved operability.

Still another object of the present invention is to provide a sheet handling apparatus capable of providing a desired sheet bundle with stapling, without trouble or inconvenience in the operation for the operator.

Still another object of the present invention is to provide a sheet handling apparatus capable of preventing troubles in sheet handling.

Still another object of the present invention is to provide a sheet handling apparatus capable of appropriately controlling the function of a recording unit and a sheet post-processing unit.

Still another object of the present invention is to provide a sheet handling apparatus capable of appropriately controlling the function of an original process unit and a sheet post-process unit.

Still another object of the present invention is to provide a sheet handling apparatus capable of preventing sheet disengagement after stapling.

Still another object of the present invention is to provide a sheet handling apparatus capable of satisfactorily stacking the sheet bundles after stapling.

Still another object of the present invention is to provide a sheet handling apparatus capable of preventing sheet disengagement or disorder of sheets.

Still another object of the present invention is to provide a sheet handling apparatus capable of controlling the sheet post-process mode according to the recording mode.

Still another object of the present invention is to provide a sheet handling apparatus capable of controlling a succeeding recording operation at an appropriate timing after the sheet post-process.

Still another object of the present invention is to provide a sheet handling apparatus capable of appropriate post-process for the sheets of different sizes.

The foregoing and still other objects of the present invention will become fully apparent from the following description, which is to be taken in conjunction with the attached drawings.

DETAILED DESCRIPTION OF THE PREFERRED EMBODIMENTS

Now the present invention will be clarified in detail by preferred embodiments thereof shown in the attached drawings.

Figure 1:
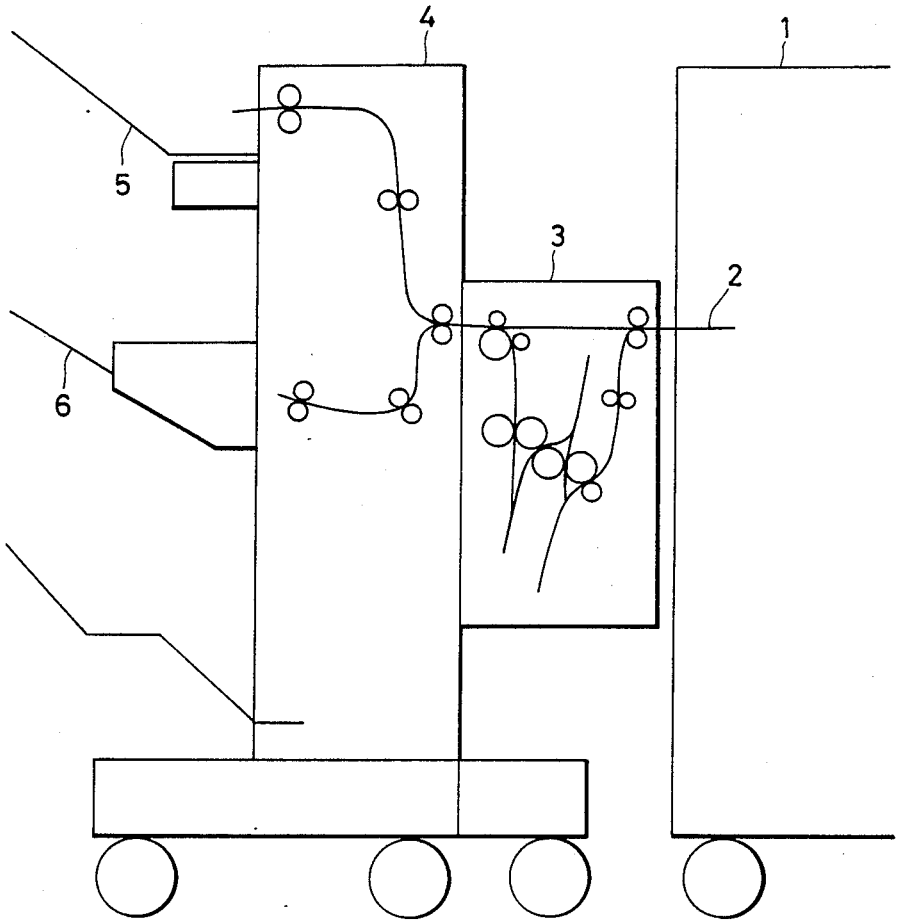
FIG. 1 is a schematic view of a sheet handling apparatus in which the present invention is applicable.

FIG. 1 shows a copying apparatus, as an example of the present invention. A recording sheet 2, discharged from a copying machine 1, is guided through a folding unit 3 to a stacker 5 or a stapling unit 6 of a finisher unit 4.

The folding unit 3 can function in one of following five modes.

Figure 2:
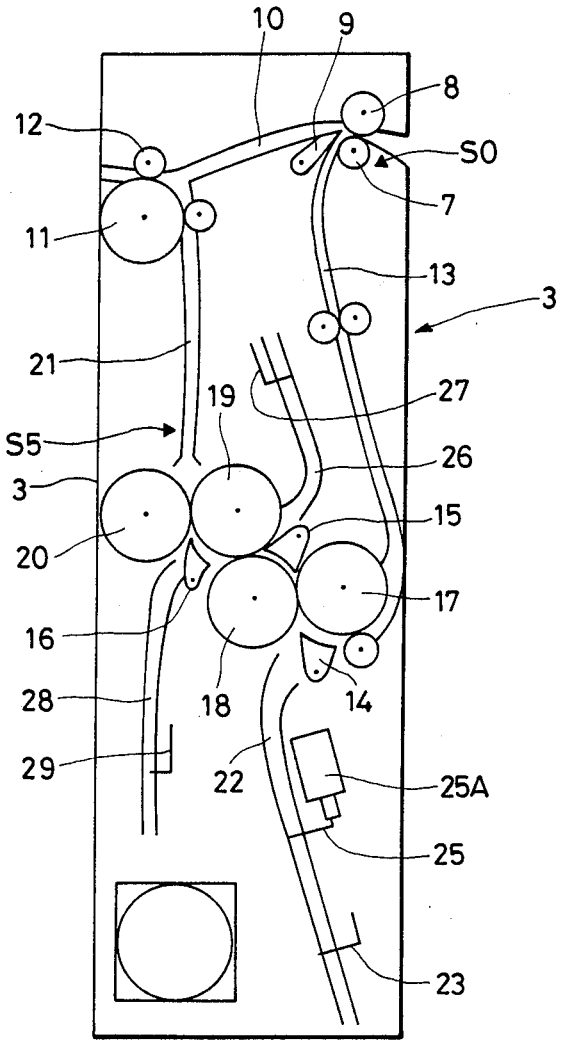
FIG. 2 is a schematic view of a folding device thereof, with sheet feed paths.

In a first through-pass mode, the sheet is not folded but merely passes the unit. In said mode, as shown in FIG. 2, the recording sheet 2 introduced by paired entrance rollers 7, 8 is guided by an entrance deflector 9 to a sheet path 10, and is forwarded by paired discharge rollers 11, 12 to the finisher unit 4.

A second folding mode is used for a half-sized sheet not exceeding A4 or B5 size. The sheet 2 is guided by the paired entrance rollers 7, 8 and the entrance deflector 9 to a sheet path 13, then guided by deflectors 14, 15 and 16 through folding rollers 17, 18, rollers 18, 19 and rollers 19, 20 to a sheet path 21 and discharged by the discharge rollers 11, 12.

Figure 3A:
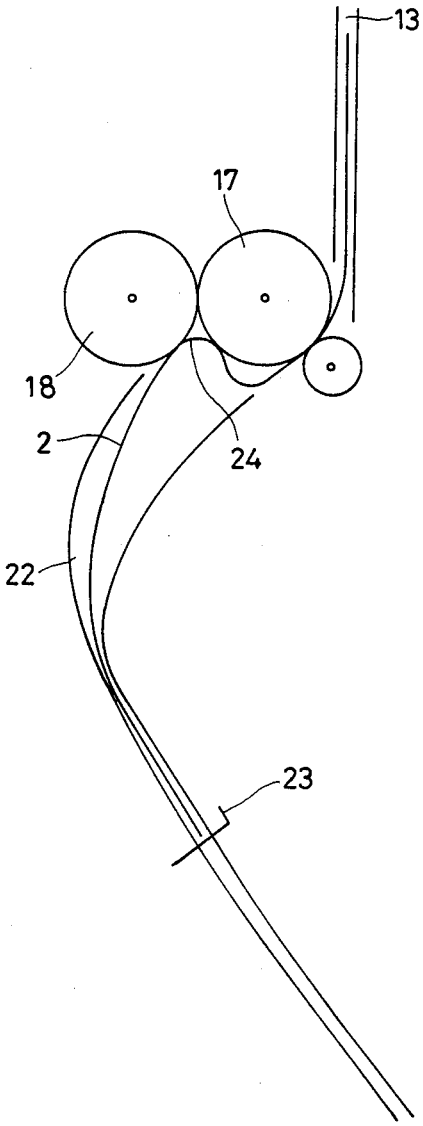
FIGS. 3A and 3B are schematic views showing the process of fold formation in a first folding unit therein.
Figure 3B:
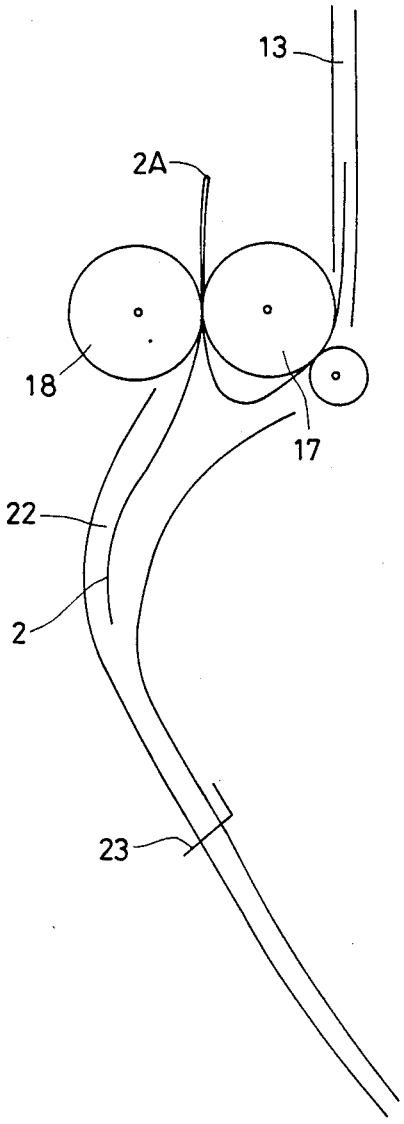
Figure 4A:
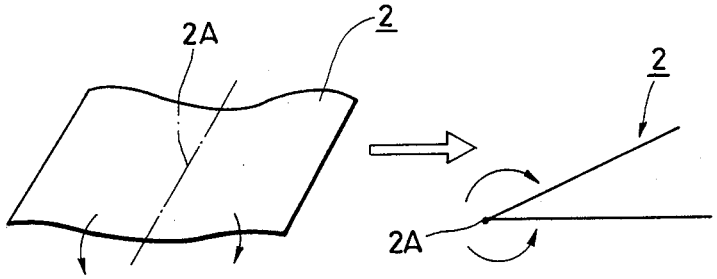
FIG. 4*a*, 4*b*, and 4*c* is a schematic view showing three forms of folds in said folding unit, in steps (A), (B) and (c)

A third folding mode is used for half-folding a recording sheet of A3 or A4 size or larger. The sheet is guided by the entrance rollers 7, 8 and the entrance deflector 9 to the sheet path 13, and is further guided by the deflector 14 into a folding path 22. Thus, as shown in FIG. 3A, a loop 24 formed in the center of the sheet when the front end thereof is stopped by a stopper 23 is caught in the nip between the folding rollers 17, 18 to form a central fold 2A as shown in FIGS. 3B and 4(A). Thus folded sheet 2 is then guided by the deflectors 15, 16 to the nip between the folding rollers 18, 19, further guided by the rollers 19, 20 into the sheet path 21 and discharged by the discharge rollers 11, 12.

Figure 4B:
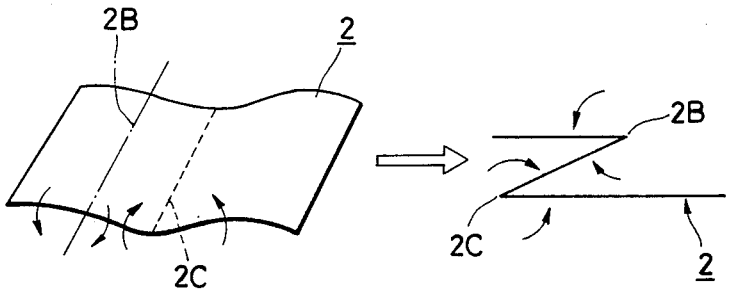

A fourth Z-fold mode is used for folding a a sheet into half and re-folding a half of thus folded sheet into half. In this mode, the recording sheet guided into the sheet path 13 through the entrance rollers 7, 8 and the entrance deflector 9 is guided by the deflector 14 into the folding path 22. When the front end of the sheet is stopped by a stopper 25 protruded by a solenoid 25A, a loop is formed at about ¼ of the sheet from the front end and is caught by the nip between the folding rollers 17, 18 to form a first fold 2B as shown in FIG. 4(B).

Subsequently, thus folded sheet 2 is introduced by the deflector 15 into a folding path 26. When said fold 2B of the sheet 2 is stopped by a stopped by a stopper 27, a loop is formed in a similar manner at about ¼ from said fold 2B and is caught by the nip of the folding rollers 18, 19 to form a second fold 2c. Thus Z-folded sheet, refolded to the front side as explained above, is guided through the deflector 16, folding rollers 19, 20 and sheet path 21 and forwarded by the discharge rollers 11, 12 to the finisher unit 4.

In a fifth rear Z-fold mode, the recording sheet 2 guided to the sheet path 13 by the entrance rollers 7, 8 and the entrance deflector 9, is introduced by the deflector 14 into the folding rollers 17, 18 and further into the folding path 26 by the deflector 15. When the front end of the sheet 2 is stopped by a stopper 27, a loop is formed at about ¼ of the sheet from the front end thereof and is caught by the nip of the folding rollers 18, 19 to form a first fold 2D as shown in FIG. 4(C).

Figure 4C:
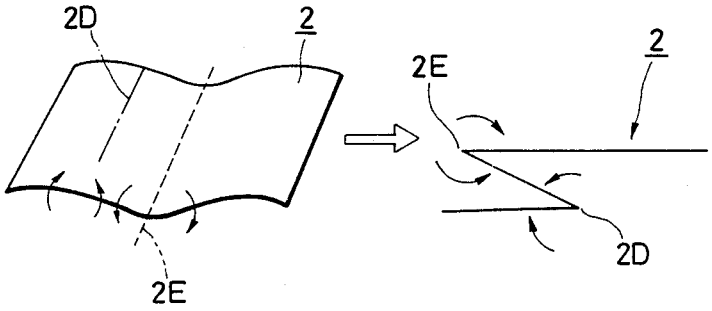

Then said sheet is guided by the deflector 16 to a folding path 28, and, when the fold 2D is stopped by a stopper 29, a loop is formed at about ¼ of the sheet 2 from said fold 2D and is caught by the nip of the folding rollers 19, 20 to form a second fold 2E as shown in FIG. 4(C).

The sheet, thus Z-folded in the rear side passes through the sheet path 21 and is discharged by the discharge rollers 11, 12.

In FIG. 2, there are shown an entrance sensor S0 for detecting the recording sheet 2 in the folding unit 3, and a fold sensor S5 provided in the final sheet path 21 for measuring the length of the folded sheet.

Figure 5:
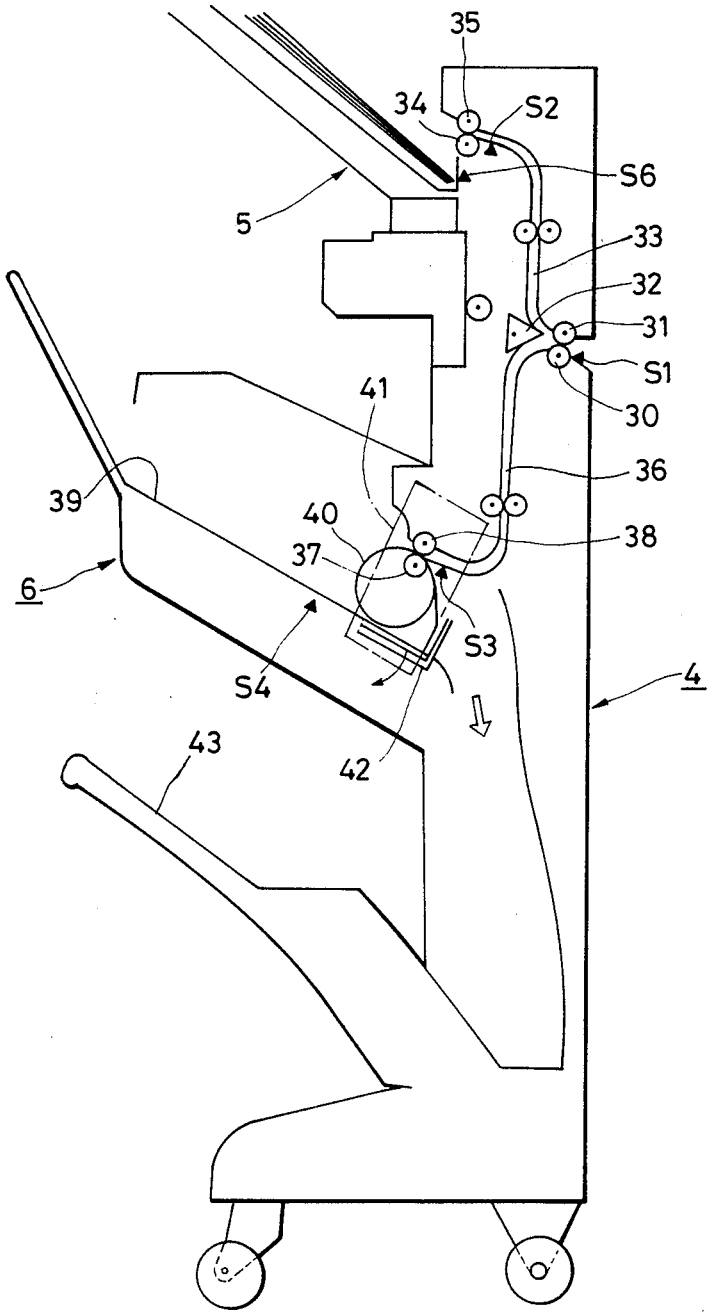
FIG. 5 is a schematic view of a finisher unit with sheet transport paths therein.

Now reference is made to FIG. 5 for explaining the finisher unit 4, which is provided with a path leading to a stacker for stacking the recording sheets 2 in succession and another path leading to a stapler unit 6 where the sheets are stapled.

In a stacker mode, the recording sheet introduced by paired entrance rollers 30, 31 is guided by a deflector 32 into a sheet path 33, and is discharged by discharge rollers 34, 35 onto a stacker 5. The stacker 5 is gradually lowered according to the stacked height of the sheets, thus accommodating a large quantity of sheets.

In a stapler mode, the sheet introduced by the entrance rollers 30, 31 is guided by the deflector 32 into another sheet path 36 and discharged by paired rollers 37, 38 onto an intermediate tray 39. A belt 40 driven on the roller 37 aligns the sheets 2.

The recording sheets 2 aligned on the intermediate tray 39 are stapled at the rear end thereof as will be explained later, and thus stapled sheet bundle is dropped, by the rotation of a stopper 42, into a lower tray 43.

There are provided an entrance sensor S1 provided at the sheet entrance of the finisher unit 4, a stacker exit sensor S2 for detecting the sheet supplied to the stacker, an intermediate tray exit sensor S3 for detecting the sheet discharged to the intermediate tray and for generating a detection signal which is utilized for counting the number of sheets discharged to said intermediate tray 39 by a counter MC to be explained later, a sensor S4 for detecting the sheet supplied to said intermediate tray 39, and a level sensor S6 provided alongside the stacker 5.

Figure 6:
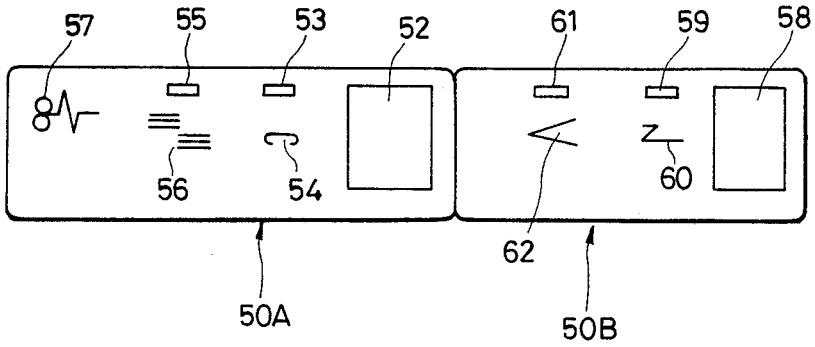
FIG. 6 is a schematic view of an operation unit for said finisher unit and folding unit.

FIG. 6 illustrates an operation unit, consisting of an operation unit 50A for the finisher unit 4 and another 50B for the folding unit 3.

In the operation unit 50A, a finisher mode selector switch 52 selects the stacker mode or the stapler mode, and lamp or LED indicators 55, 53 indicate the mode selected by the switch 52. The indicator 55 indicates the stacker ode in combination with simultaneous picture display 56, and the indicator 53 indicates the stapler mode in combination with simultaneous picture display 54.

In the operation unit 50B, a mode selector switch 58 selects the folding mode or the Z-folding mode. Lamp or LED indicators 61, 59 indicates the mode selected by the switch 58. The indicator 61 indicates the simple folding mode in combination with a picture display 62, and the indicator 59 indicates the Z-fold mode in combination with a picture display 60. A jam indicator 57 indicates a sheet jam in the folding unit 3 or in the finisher unit 4. The rear Z-fold mode can be selected by an unrepresented selector switch provided in the folding unit 3.

The finisher unit 4 in the present embodiment can select, in addition to the stacker mode and the stapler mode, a book stapling mode, in which the copying unit effects copying operation without selecting the document feeder and the obtained copies are stapled.

In FIG. 6, the book stapling mode can be represented by extinguishing the indicators 55, 53, either of which is lighted in the stacker mode or the stapler mode.

However, it is naturally possible to add an indicator or a particular switch for this purpose.

Figure 7:
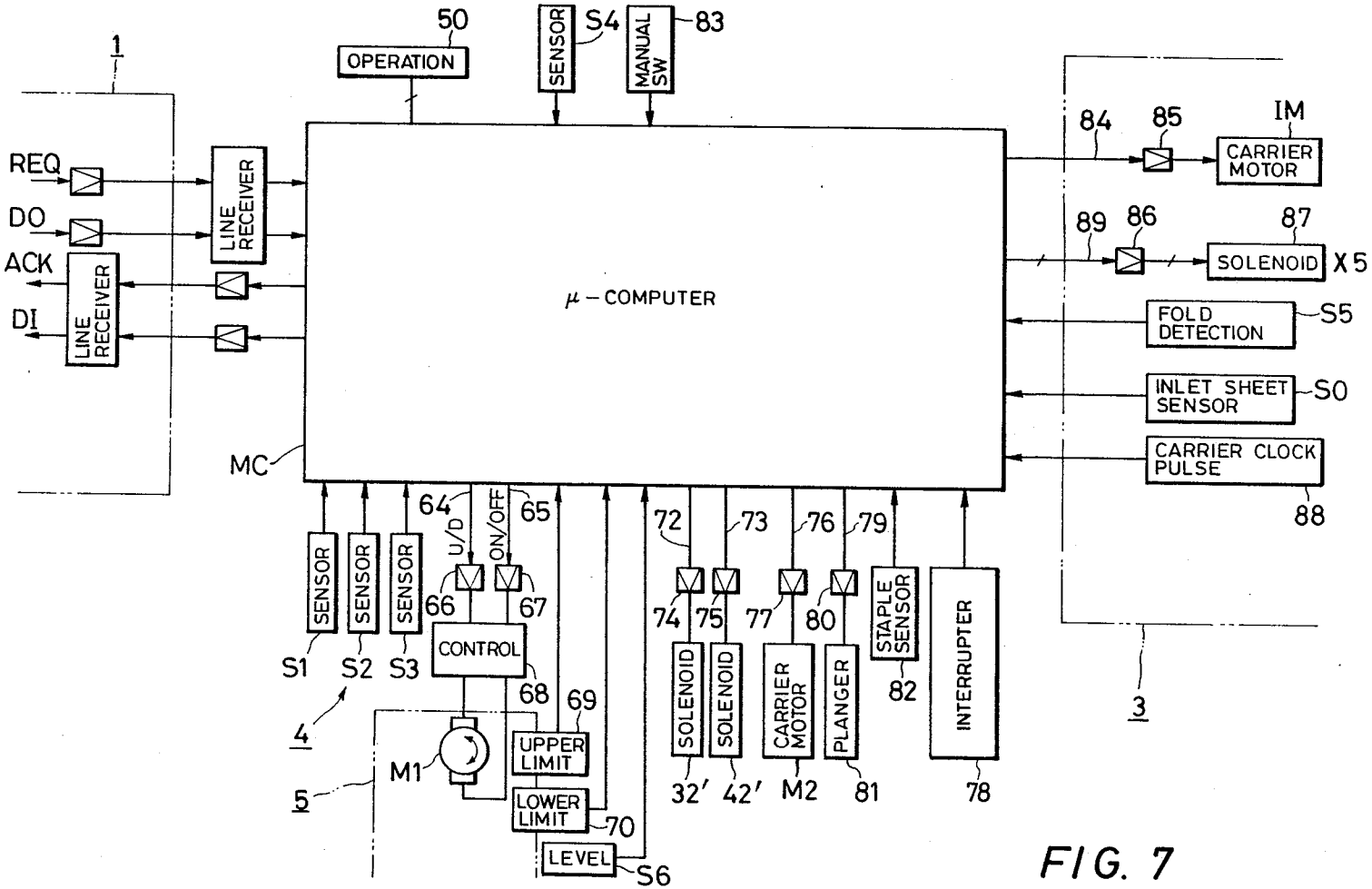
FIG. 7 is a block diagram of a control circuit for the sheet handling apparatus of the present invention.

FIG. 7 is a block diagram of an example of the control circuit for the sheet handling apparatus of the present invention.

A control unit of the copying machine 1 and a microcomputer MC of the finisher unit 4 mutually communicate by a synchronous serial communication. In response to a communication request signal REQ from the copying machine 1, the finisher unit returns an acknowledge signal ACK, and each data signal D0 is responded by data signal DI. The data signal D0 from the copying machine mostly indicate intermediate states such as start of copying, end of copying, copy size, number of copies, sheet jam, document feeder mode, book mode etc., while the data signal DI from the finisher unit indicates number of completed sheets, nonstapling mode, sheet jam etc. 50 indicates the operation unit shown in FIG. 6. S1, S2, S3 and S4 are, as already explained, the finisher entrance sensor, stacker exit sensor, intermediate tray exit sensor and intermediate tray sheet sensor, respectively. An up/down signal U/D and an on/off signal ON/OFF for controlling the up/down motion and for on/off control of the stacker 5 are supplied to a control circuit 68 respectively through buffers 66, 67 to control a stacker motor M1. The stacker 5 is also provided with an upper limit sensor 69, a lower limit sensor 70 and a stacker level sensor S6 which also contribute to the control of the stacker motor M1.

A signal 72 controls a deflector 32 provided at the entrance of the finisher unit 4 (FIG. 5), by controlling a solenoid 32A through a buffer 74, thereby sending the recording sheet 2 either to the stacker 5 or to the intermediate tray 39.

A signal 73 control the stopper 42, by controlling a solenoid 42A through a buffer 75, thereby dropping the stapled sheet bundle to the-lower tray 43.

A signal 76 drives a transport motor M2 for the recording sheet 2 through a buffer 77, while a signal 79 drives a stapling plunger 81, to be explained later, through a buffer 80. An interrupter 78 generates pulses in proportion to the revolution of the transport motor M2, and a sensor 82, for example of reflection type, detects the presence of a staple at the stapler unit 6 as will be explained later.

A manual stapling switch 83 is used in the book mode or in the stapling mode.

With respect to the folding unit 3, a signal 83 drives a sheet transport motor IM through a buffer 85, and a mode signal 89 selectively drives five deflectors mentioned above and a stopper solenoid 87 according to the selected folding mode. An interrupter releases pulses in proportion to the revolution of the motor IM.

Figure 8:
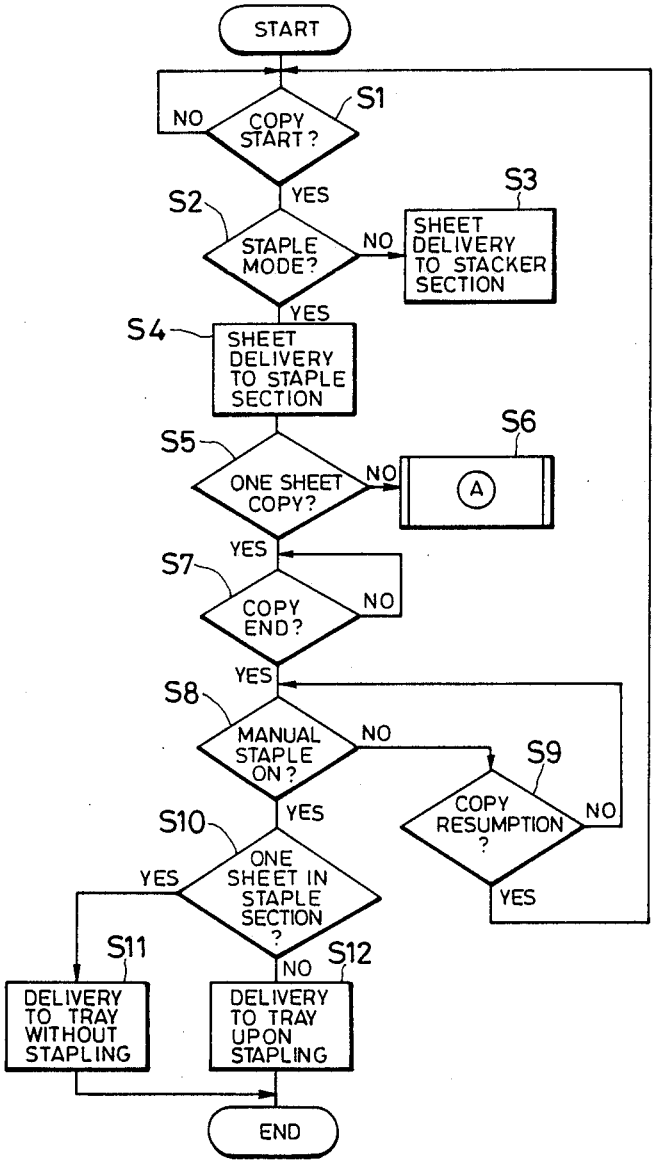
FIG. 8 is a flow chart showing the control sequence in an embodiment of the present invention.

Now reference is made to FIG. 8, for explaining the control sequence in the present embodiment, in which a single copy is discharged to the tray 43 without stapling. In response to the detection of the start of a copying operation in a step S1, the folding unit 3 and the finisher unit 4 are activated, and a step S2 discriminates whether the stapler mode is selected.

If not, the program proceeds to a step S3 to discharge the sheets to the stacker unit 5. On the other hand, if the stapler mode is identified in the step S2, the program proceeds to a step S4 to discharge the sheets to the stapler unit 6. Then a step S5 discriminates, from the data signal supplied from the copying machine 1, whether the preset copy number is one, and, if not, the program proceeds to a step S6 to enter a flow (A) not directly related to the present invention.

On the other hand, if a single sheet copying is identified in the step S5, a step S7 discriminates whether the copying operation has been terminated, and a step S8 then discriminates whether the manual stapling switch 83 is turned "on". If not, the program returns from a step S9 to the step S1, thus repeating the foregoing sequence starting from the step S2 for a next sheet.

Also, if the manual switch is turned "on" in the step S8, the program proceeds to a step S10, and, if the stapler unit 6 contains only one sheet without succeeding sheets, the program proceeds to a step S11 to discharge the sheet to the lower tray 43 without stapling. On the other hand, in case single sheet copying is conducted in succession, so that the stapler unit 6 contains plural sheets, the program proceeds to a step S12 to activate the stapler 41 and to discharge the stapled sheets to the lower tray 43, thus achieving the stapling in book mode.

Figure 9:
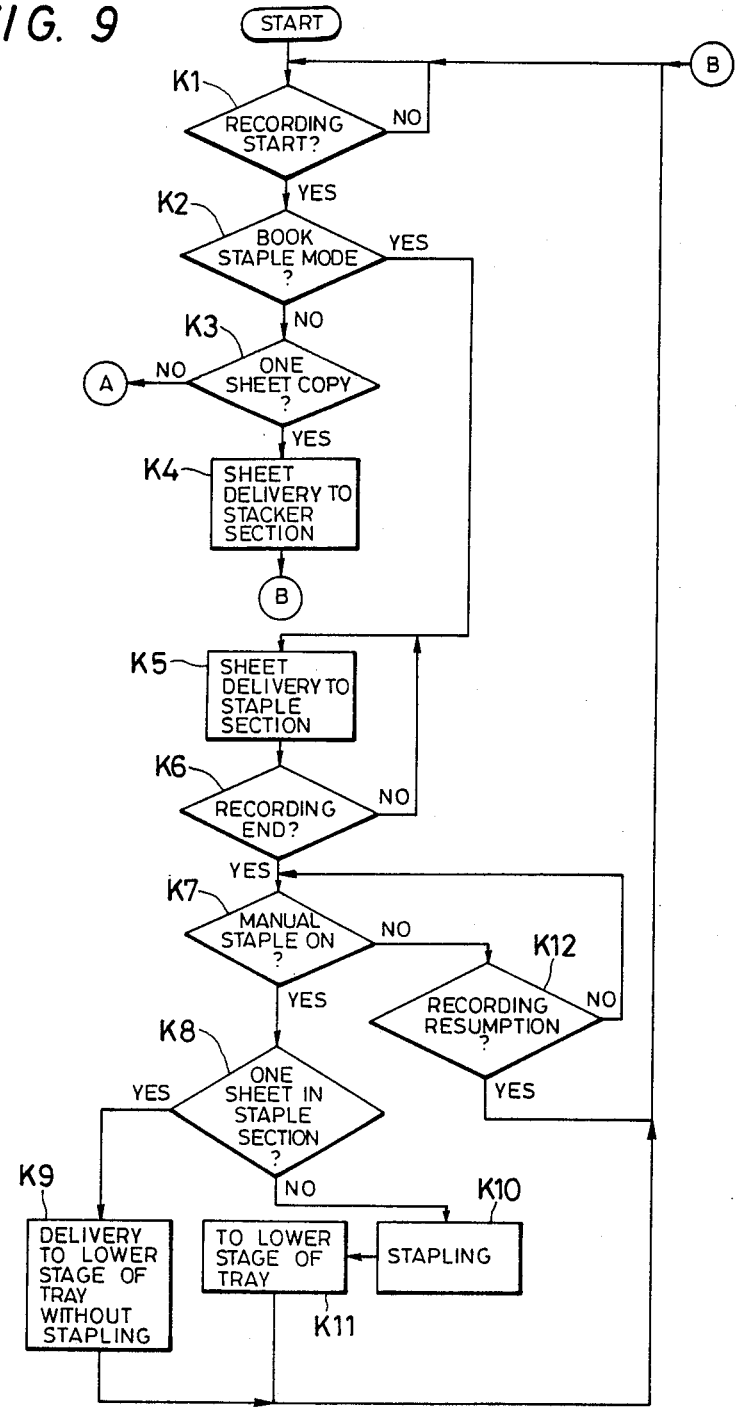
FIG. 9 is a flow chart showing the control sequence in another embodiment of the present invention.

Now reference is made to FIG. 9 for explaining another embodiment which can select a mode of automatic stapling after copying or another mode of stapling by a manual instruction. In response to the detection of start of a copying operation in a step K1, the folding unit 3 and the finisher unit 4 are activated, and a step K2 discriminates, by a book mode signal from the copying machine, and a stapler mode selection signal from the operation unit 50, whether the book stapling mode is selected.

If not, the program proceeds to a step K3 to discriminate, by the copy number data from the copying machine 1, whether a single sheet copying is selected. If such single sheet copying is identified the program proceeds to a step K4 to discharge the sheet to the stacker unit 5, but, if such copying is not selected, the program proceeds to a flow A, which is not directly related to the present invention and will not, therefore, be explained further.

If the step K2 identifies the book stapling mode, the program proceeds to a step K5 to discharge the sheet to the stapler unit 6. A next step K6 discriminates whether a series of recording has been completed, and, after the sheet discharge to the stapler unit 6 is continued until such completion, a step K7 discriminates whether the manual-stapling switch 83 has been turned on.

If it is turned on, a step K8 discriminates whether only one sheet has been supplied to the stapler unit 6, and, if so, the program proceeds to a step K9 to drop the sheet from the stapler unit 6 to the lower tray 43. On the other hand, if there are plural sheets, a step K10 effects stapling and a step K11 drops thus stapled sheets to the lower tray 43.

On the other hand, if the manual stapling switch 83 is turned on in the step K7, the program proceeds to a step K12 to discriminate whether a next recording operation has been started, and, if started, the program returns to the step K1.

In the above-explained structure, the stapling operation can be executed by a switch for this purpose. It is therefore rendered possible to effect stapling in the book copy mode, and to send the copies to an easily accessible tray automatically, even if the operator erroneously selects the stapler mode in case of single sheet copying.

In the following there will be explained the detection of defective sheet folding and the corresponding control in the present embodiment. At first there will be explained the function of defective folding detection in the present embodiment. Such detection is conducted by the fold sensor S5, of the folding unit 3 shown in FIG. 2, which is positioned along the final sheet path 21 and measures the length of the passing recording sheet 2 in the finally folded state.

Figure 10A:
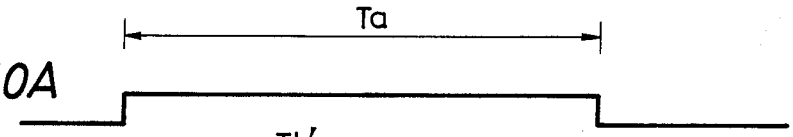
FIG. 10*a*, 10*b* and 10*c* is a wave from chart showing a detection signal from a fold sensor and clock pulses.

For the ease of understanding, there will be explained a case of simple half-folding. If an unfolded A3-sized sheet 2 passes through the position of said fold sensor S5, there will be obtained a signal Ta, as shown in FIG. 10(A), representing the period of presence of said sheet.

Figure 10B:
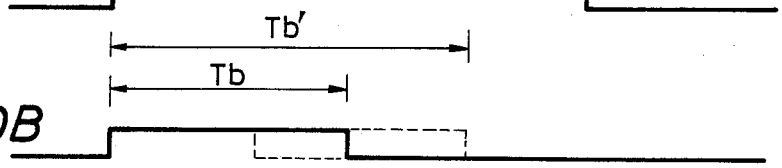
Figure 10C:
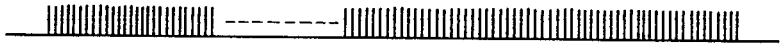

The microcomputer MC receives clock pulses as shown in FIG. 10(C) from the interrupter 88, and can measure the length of the folded sheet by counting the number of said clock pulses during said signal T.

Figure 11A:
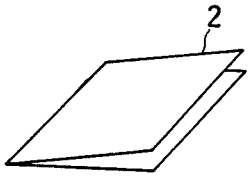
FIGS. 11A and 11B are perspective views respectively showing a proper fold and an improper fold of the recording sheet.
Figure 11B:
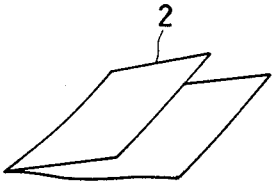

On the other hand, a properly half-folded sheet 2, as shown in FIG. 11A, provides a signal Tb, shown in FIG. 10(B), of which duration is a half of that of the signal Ta. Also an improperly folded sheet as shown in FIG. 11B provides another signal Tb' as shown in FIG. 10(B).

In response to such detection signal Tb', the microcomputer MC identifies an improper folding, prohibits the stapling operation, and activates to discharge said improperly folded sheet 2 to the lower tray 43 instead of the stapler unit 6 (cf. FIG. 5).

Figure 11D:
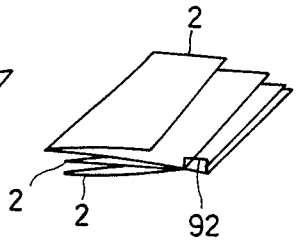
FIGS. 11C and 11D are perspective views respectively showing a proper stapling and an improper stapling of plural recording sheets.
Figure 11C:
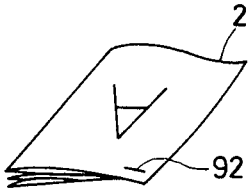

FIC. 11C shows a state of proper stapling of plural folded sheets 2, while FIG. 11D shows that the stapling is conducted improperly if the improper folding is not detected as in the conventional art, wherein 92 is a staple.

Instead of counting the pulses from the interrupter as explained above, the microcomputer may count internal clock pulses.

Figure 12:
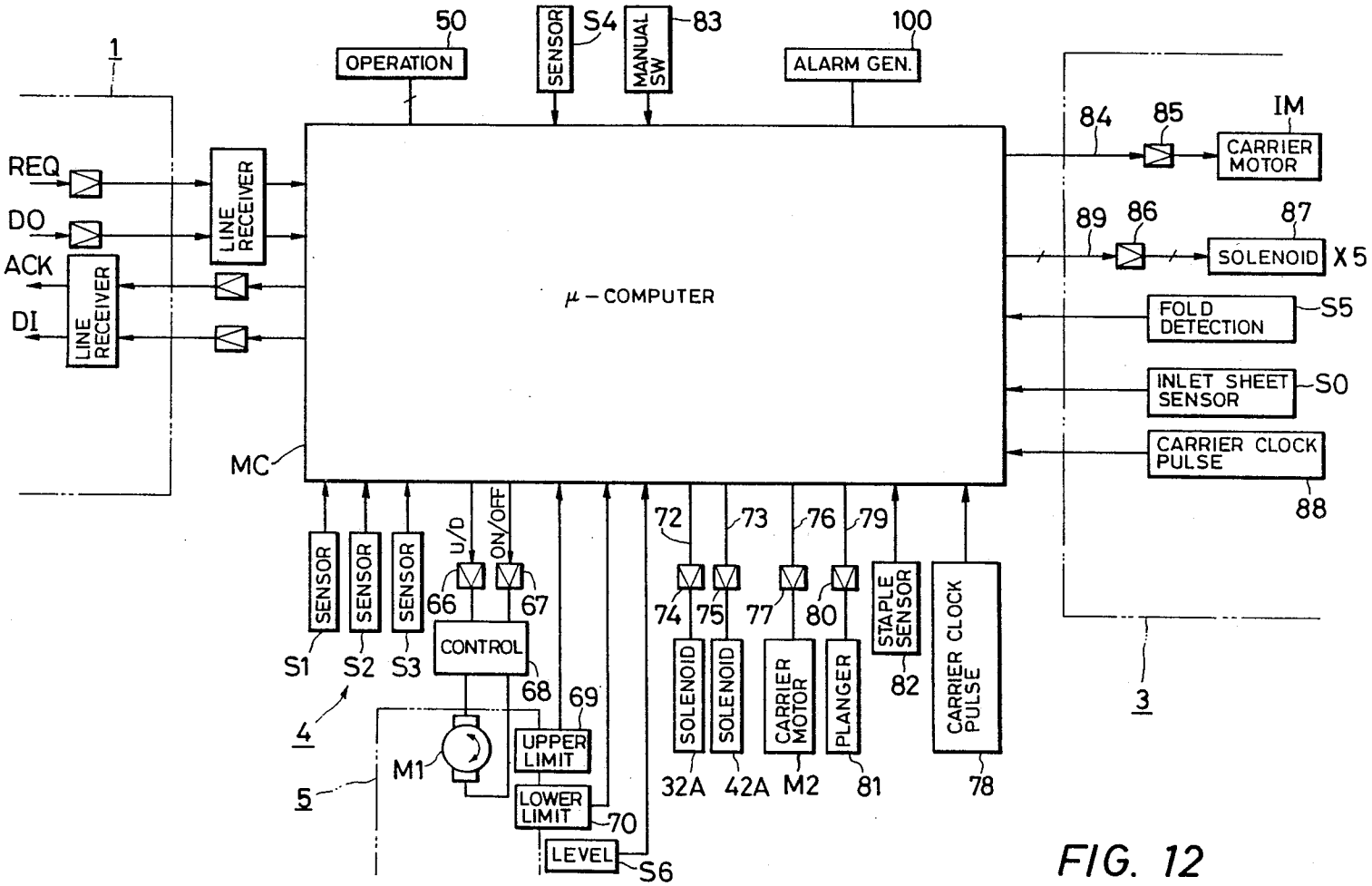
FIG. 12 is a block diagram of a control circuit adapted for giving an alarm in response to the detection of an improper sheet fold.

It is also possible to generate an alarm in response to the detection of an improper folding, and FIG. 12 shows a control circuit for such embodiment.

In FIG. 12, alarm generating means 100 provides an alarm in response to the detection of an improper folding by the microcomputer MC based on a signal from the sensor S5, and may be composed for example of a buzzer, a bell, an alarm device providing a synthesized sound, a liquid crystal display unit, an indicator lamp such as a LED, or combinations thereof.

Such alarm generating means may be incorporated in the operation unit 50.

Other components are same as those in FIG. 7 and will not, therefore, be explained further.

Figure 13:
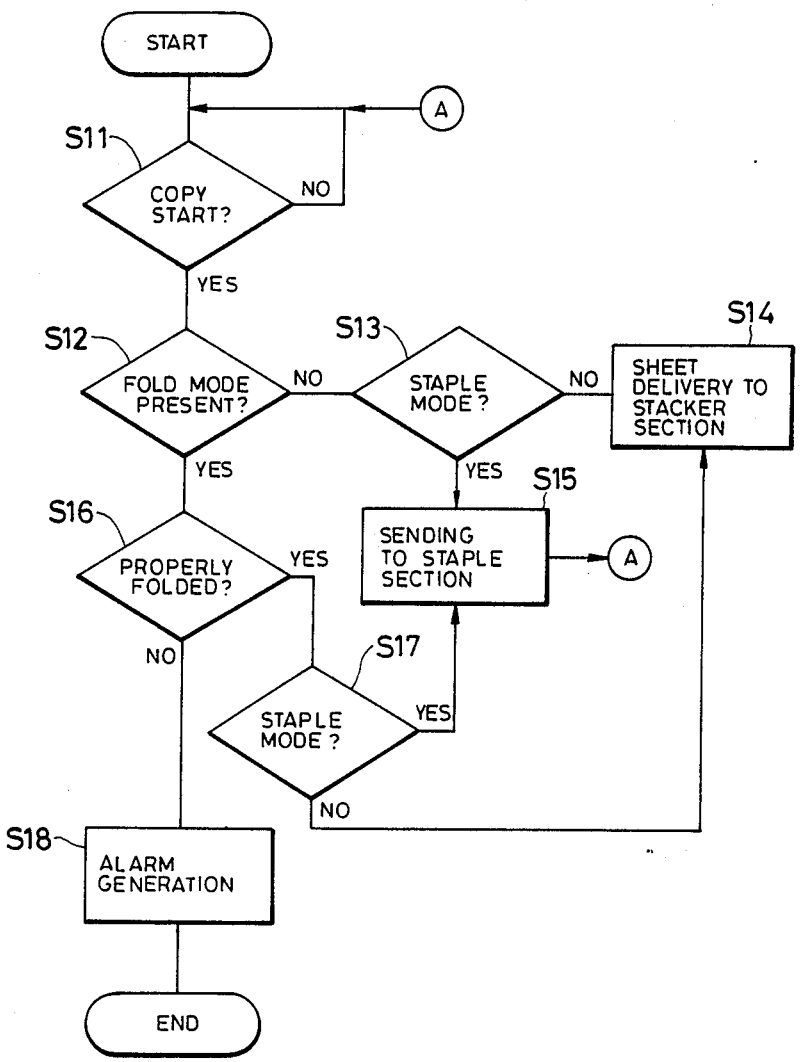
FIG. 13 is a flow chart showing corresponding control sequence.

FIG. 13 shows a flow chart of the control sequence capable of generating an alarm in response to the detection of an improper folding.

At first, in response to the detection of start of a copying operation in the recording or copying apparatus 1 in a step S11, the folding unit 3 and the finisher unit 4 are activated, and a step S12 discriminates whether a folding mode has been selected. If not, the program proceeds to a step S13 for discriminating whether the stapling mode has been selected, and, if not, the program proceeds to a step S14 to discharge the sheet directly to the stacker unit 5. In case of the stapler mode, a step S15 feeds the sheet to the stapler unit.

On the other hand, if the step S12 identifies a folding mode, a step S16 discriminates whether the folding is done properly, and, if proper, a step S17 discriminates whether the stapler mode has been selected. In case of the stapler mode, the step S15 feeds the sheet to the stapler unit 6, or, if not, the step S14 feed the sheet to the stacker unit 5. The functions after sheet discharge to the stapler unit are not related with the present embodiment and will not, therefore, be explained further.

Then, if the step S16 identifies an improper sheet folding, the program proceeds to a step S18 to cause the alarm means 100 to generate an alarm. If desirable it is also possible to suspend the ensuing recording operation.

Figure 14:
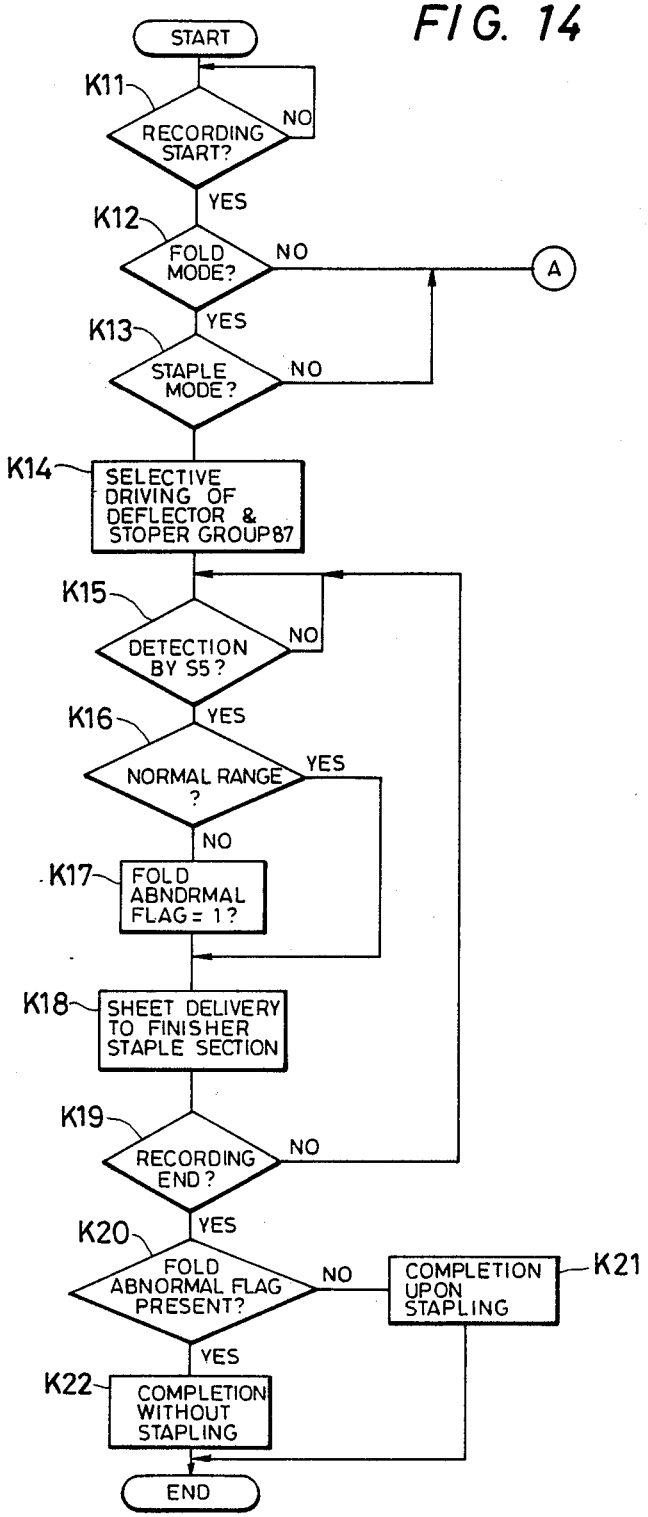
FIG. 14 is a flow chart showing a control sequence for prohibiting the stapling in response to the detection of an improper fold.

It is also possible to prohibit the stapling operation in response to the detection of an improper sheet folding, and FIG. 14 is a flow chart showing control sequence in such embodiment.

In response to the detection of start of a recording operation in a step K11, the folding unit 3 and the finisher unit 4 are activated, and steps K12 and K13 discriminate whether the folding mode and the stapler mode are selected. The program proceeds to a step K14 only if the discriminations in said steps are both affirmative, but otherwise proceeds to a flow A which is not directly related with the present embodiment and will not, therefore, be explained further.

The step K14 selectively activates the deflectors and stopper 87 for the aforementioned three folding modes (half-fold mode, Z-fold mode and rear Z-fold mode), and a succeeding step K15 identifies the start of passing of the sheets by the fold sensor S5. A step K16 discriminates whether the time required for the sheet to pass through the sensor S5 is within a normal range, by counting the clock pulses from the interrupter 88, thereby identifying whether the folding is properly done. If an abnormality is found, a step K17 sets an abnormality flag "1" in a predetermined area of RAM in the microcomputer MC, and the program proceeds to a step K18. On the other hand, if the step K16 identifies a normal folding, the program directly proceeds to the step K18 for discharging the sheet to the stapler unit of the finisher unit 4. A next step K19 discriminates whether the recording operation has been completed, and, if not, the program returns to the step K15 to repeat the above-explained procedure.

When the recording operation is completed, a step K20 discriminates whether all the folding operations are proper, and, if so, a step K21 executes the stapling operation.

On the other hand, if the step K20 identifies the abnormality flag "1" indicating the presence of an abnormality, the program proceeds to a step S22 to rotate the stopper 42 without stapling, thereby dropping the sheets to the lower tray 43.

As explained in the foregoing, the stapling operation is prohibited in response to an improper folding. Therefore the operator needs not remove the staple on improperly folded sheets but is only required to staple the sheets after refolding the improperly folded sheets.

Figure 15:
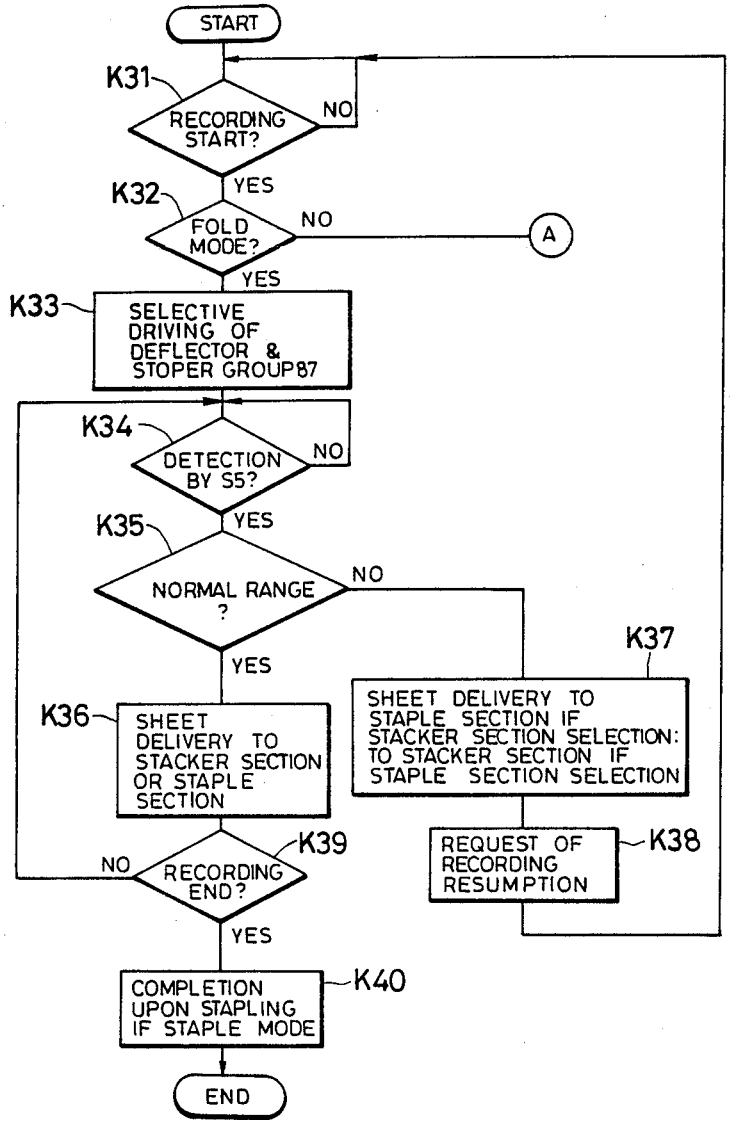
FIG. 15 is a flow chart showing a control sequence for varying the sheet transport destination in response to the detection of an improper fold.

It is furthermore possible to change the destination of a sheet when an improper folding is found on said sheet, and FIG. 15 shows a flow chart indicating the control sequence in such embodiment. Upon detection of the start of a recording operation in a step K31, the folding unit 3 and the finisher unit 4 are activated, then a step K32 discriminates whether a folding mode has been selected, and, if so, the program proceeds to a step K33. If not, the program proceeds to another flow A which is not directly related to the present invention and will not, therefore, be explained further. The step K33 selectively activates the deflectors and-stopper 87 for the aforementioned three folding modes (half-folding mode, Z-fold mode and rear Z-fold mode), and a next step K34 discriminates the start of passing of the sheets by the fold sensor S5. Then a step K35 discriminates whether the time required by the sheet to pass through the fold sensor S5 is within a normal range, by counting the clock pulses from the interrupter 88. If it is within said normal range, a step K36 feeds the sheet to the stacker unit 5 or the stapler unit 6 of the finisher unit 4 according to the selected mode.

On the other hand, if the step K35 identifies an abnormal folding, a step K37 shifts the entrance deflector 32 to guide the sheet to a sheet path of the finisher unit 4 opposite to that in the selected path, then a step K38 requests a re-copying by transmitting the improper folding state to the copying machine, and the program returns to the step K31. In this manner the number of copies is corrected in case of such improper folding. On the other hand, after the step K36, a step K39 discriminates whether the recording operation has been completed, and, if not, the program returns to the step K34 to repeat the above-explained sequence. On the other hand, if the recording operation has been completed, the program proceeds to a step K40 for effecting a stapling operation if the stapler mode is selected, and the sequence of the finisher unit 4 is thus terminated.

As explained above, in response to the detection of an improper folding, the entrance deflector is shifted to a position opposite to that in the selected mode, thereby discharging the improperly folded sheet to a tray different from the tray in the selected mode, and the number of such defective sheets is compensated. In this manner the apparatus is operated in the correct function mode until the preset copy number is reached, and the operator can assuredly obtain the sheets aligned and collated in normal manner.

In the following there will be explained the control operation among the entire apparatus when a both-side copying machine equipped with a recycling document feeder is combined with a folding unit and a finisher unit.

Figure 16:
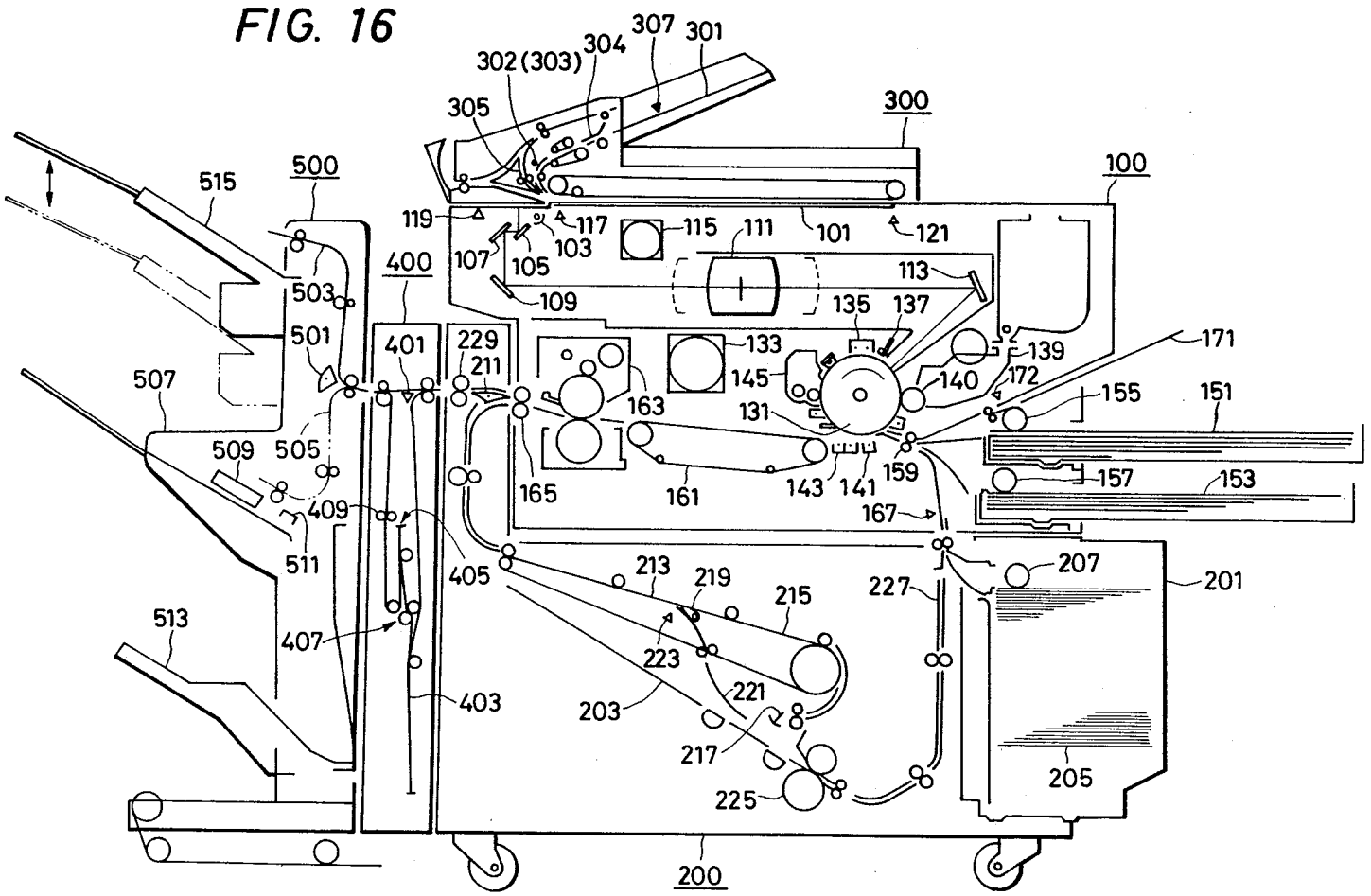
FIG. 16 is a cross-sectional view of a sheet handling apparatus composed of a two-side copying machine, a recycling document feeder, a folding unit and a finisher unit.
Figure 17A:
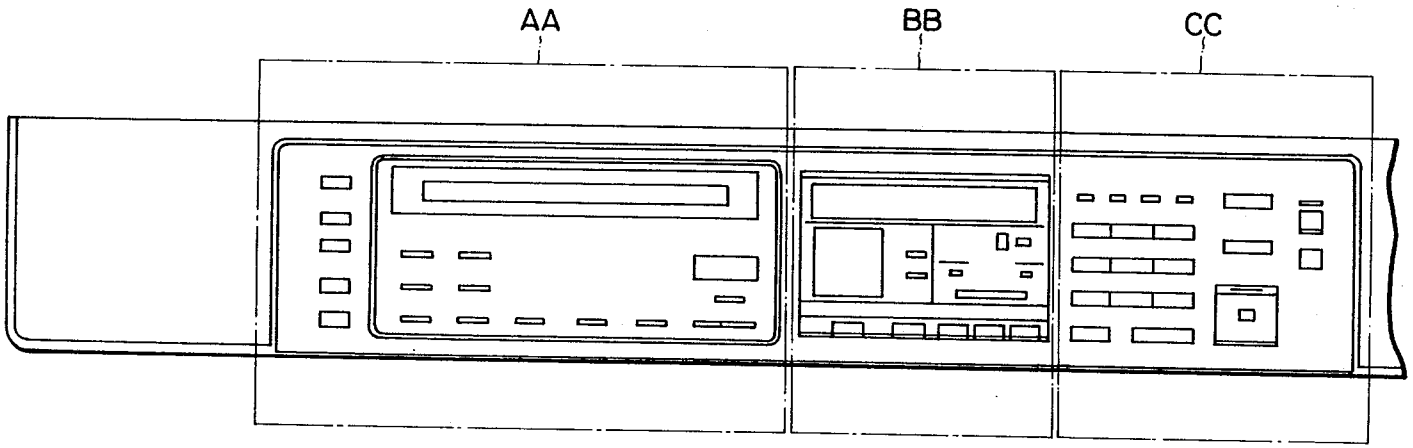
FIGS. 17A to 17D are schematic views of an operation unit of the two-side copying machine shown in FIG. 16.
Figure 17B:
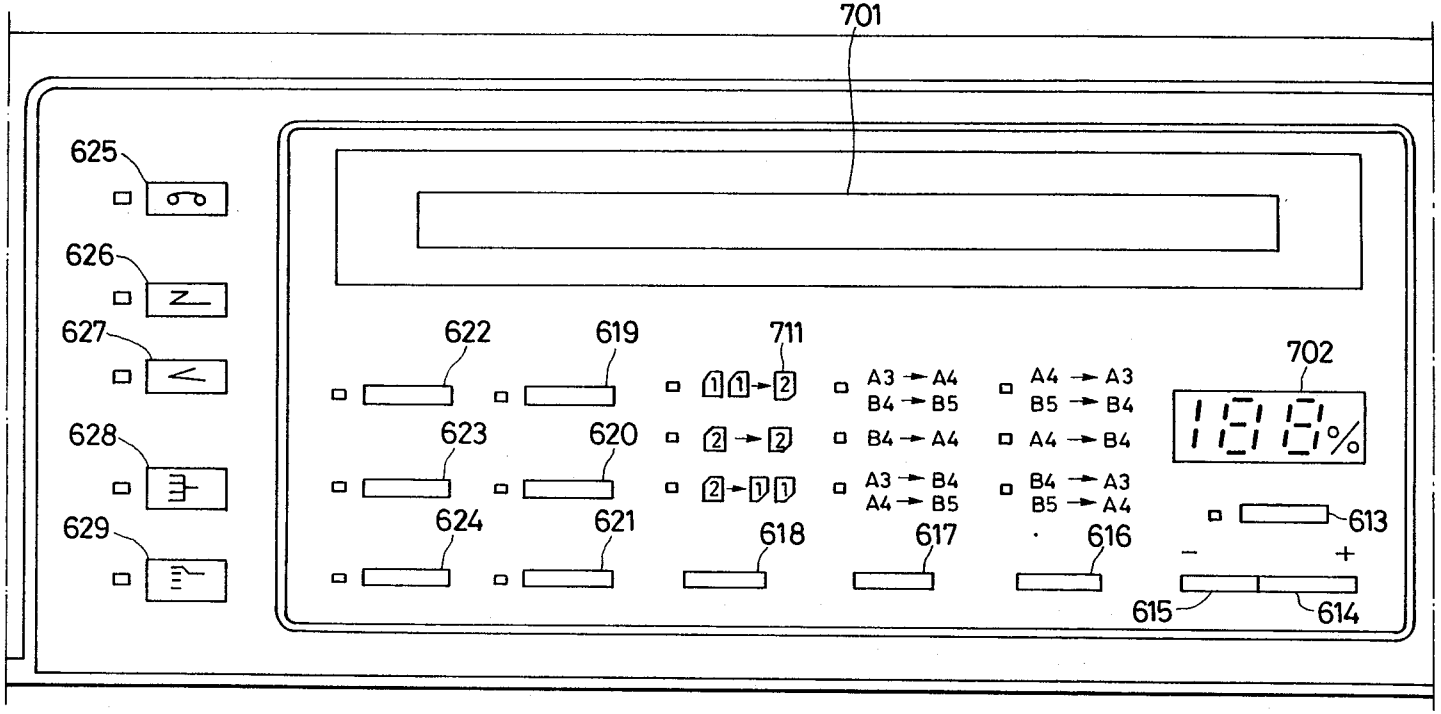
Figure 17C:
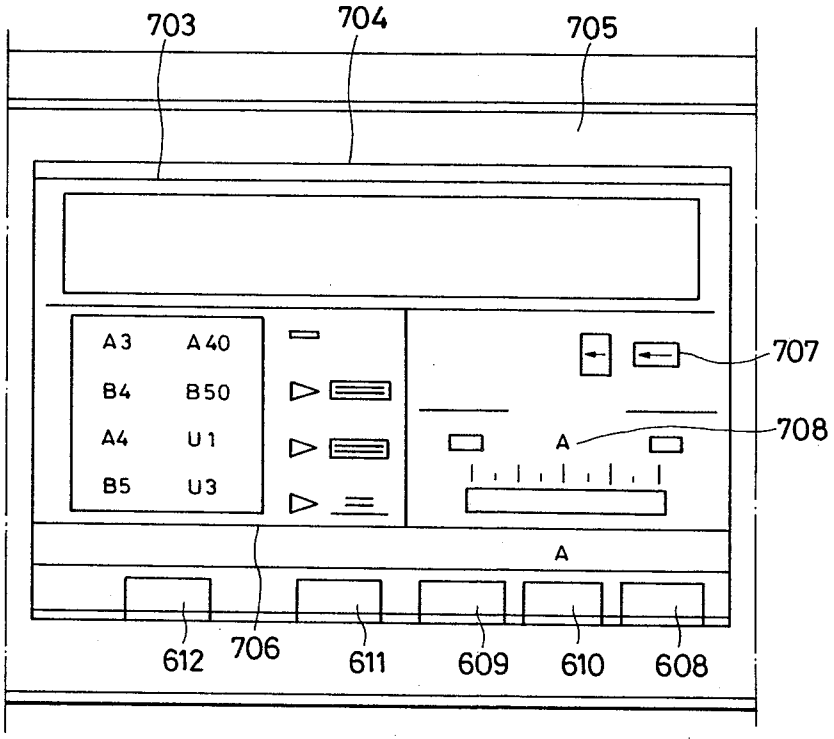
Figure 17D:
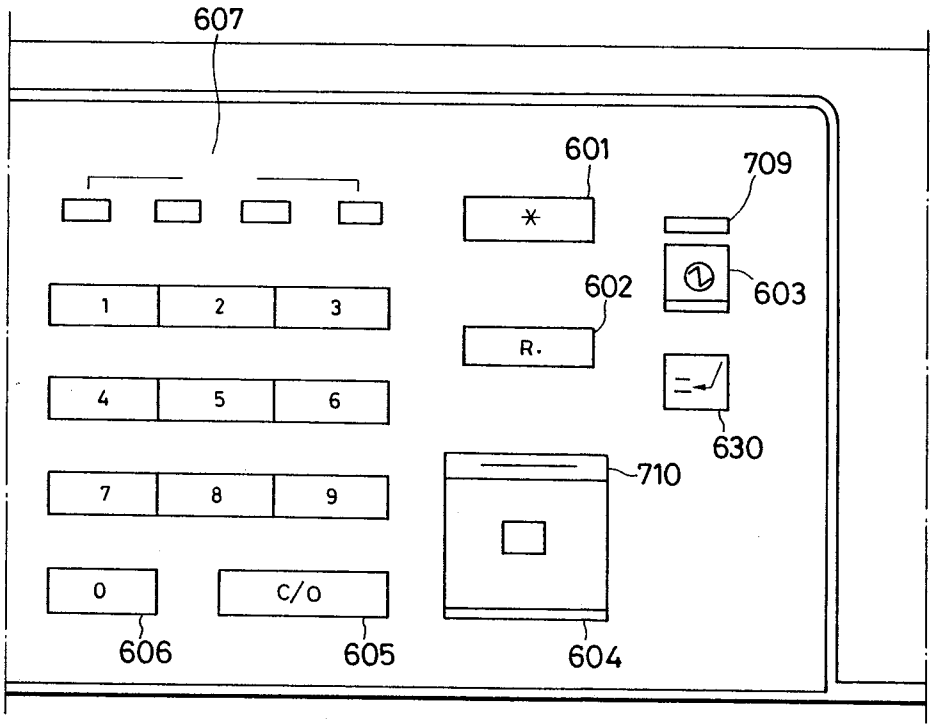

FIG. 16 shows the internal structure of such an embodiment, wherein provided are a copying machine 100 capable of image reading and image recording; a pedestal 200 capable of a two-side process function for inverting the recording sheet in case of two-side recording and a multiple record function for effecting plural recordings on a same recording sheet; a recycling document feeder (RDF) 300 for automatic feeding of the original documents; a folding unit 400 for folding the sheet at a predetermined position; and a finisher unit 500 for sorting and stapling the recording sheets. The above-explained units 200–500 can be combined with the copying machine 100 in arbitrary combinations.

A. Copying machine (100)

In the copying machine 100, there are provided an original support glass 101 for supporting an original document; an exposure lamp 103 for illuminating the original document; scanning mirrors 105, 107, 109 for deflecting the path of the light reflected by the original; a lens 111 capable of imaging and varying image magnification; a motor 115 for driving an optical system; and sensors 117, 119, 121.

There are further shown a photosensitive drum 131; a main motor 133 for driving said photosensitive drum 131; a high-voltage source 135; a blank exposure unit 137; a developing unit 139; a transfer charger 141; a separating charger 147; and a cleaning unit 145.

There are further provided an upper cassette 151; a lower cassette 153; sheet feed rollers 155, 157; registration rollers 159; a conveyor belt 161 for transporting the recording sheet after image recording to a fixing unit; a fixing unit 163 for fixing, by heat and pressure, the image on the transported sheet; and a sensor 167 employed in two-side recording.

There are further shown a manual-feed sheet tray 171 for manual feeding of the recording sheet; and a manual-feed sensor 172 which detects a manually inserted recording sheet, wherein the manual feed mode is selected upon said detection.

Said photosensitive drum 13 is provided, on the periphery thereof, with a seamless photosensitive member comprising a photoconductive member and a conductive member, is rotatably supported and is rotated in the direction of arrow, by the main motor 133 activated in response to the actuation of a copy start key to be explained later. After a pre-rotation process of the drum 131, consisting of a rotation control and a potential control, the original document placed on the glass 101 is illuminated by the lamp 103 constructed integrally with the first scanning mirror 105, and the light reflected from said original is guided through the first scanning mirror 105, second scanning mirror 107, third scanning mirror 109, lens 111 and fourth scanning mirror 113 and focused on the drum 131.

The drum 131 is at first charged by a corona discharge generated by the high-voltage source 135, and is then exposed, through a slit, to the image of the original illuminated by the lamp 103. Thus an electrostatic latent image is formed on the drum 131 through already known NP process.

The latent image on the drum 131 is rendered visible as a toner image by development with a developing roller 140 in the developing unit 139, and said toner image is transferred onto a recording sheet by the transfer charger 141.

The recording sheet contained in the upper cassette 151 or the lower cassette 153 is fed by the roller 155 or 157 into the copying machine, and is forwarded by the registration rollers 159 toward the photosensitive drum 131 with such an exact timing that the front end of the sheet coincides with that of the latent image. The toner image on the drum 131 is transferred onto the sheet when it pauses between the transfer charger 141 and the drum 131 Subsequently the sheet is separated from the drum 131 by the separating charger 143, then guided to the fixing unit 163 by the conveyor belt 161, subjected to image fixation therein by pressure and heating, and is finally discharged from the copying machine 100 by discharge rollers 165.

After image transfer, the drum 131 continues to rotate and is subjected to surface cleaning by the cleaning unit 145 composed of a cleaning roller and an elastic blade.

B. Pedestal (200)

The pedestal 200 is detachable from the main body 100, and is provided with a deck 201 for accommodating 2,000 recording sheets, and an intermediate tray for two-side copying. A lifter 205 elevates said deck 201 in such a manner that the recording sheets are constantly in contact with a feed roller 207.

There are also shown a sheet discharge flapper 211 for selecting a path for multiple recording or a path for sheet discharge; paths 213, 215 for a conveyor belt; an intermediate tray weight 217 for pressing the sheets, wherein the recording sheet guided through the flapper 211 and the paths 213, 215 is inverted and stored in the intermediate tray 203; a multiple recording flapper 219 for selecting a path for two-side recording or a path for multiple recording, positioned between the paths 213 and 215 and guiding the sheet to a path for multiple recording 221 when rotated upwards; a multiple recording sheet discharge sensor 223 for detecting the rear end of the recording sheet passing through the flapper 219; a sheet feed roller 225 for feeding the sheet toward the drum 131 through a path 227; and discharge rollers 229 for discharging the recording sheet from the unit.

In the two-side recording or multiple recording, the flapper 211 is shifted upwards to guide the recording sheet through the paths 213, 215 of the pedestal 200 to the intermediate tray 203 therein. The multiple recording flapper 219 is lowered or elevated or lowered respectively in the two-side recording or in the multiple recording. Said intermediate tray 203 can accommodate, for example, 99 sheets at maximum, and the sheet stored therein are maintained in place by the weight 217.

In the succeeding recording on the rear face or in the succeeding recording in multiple recording, the sheets stored on the intermediate tray 203 are fed, one by one from the bottom, by means of the feed roller 225 and the weight 217 and through the path 227, to the registration rollers 159 of the main copying machine 100.

C. Recycling Document Feeder (300)

In the RDF 300, there are provided a stacker tray 301 for supporting the original documents, and original size sensors 302, 303, which are positioned perpendicularly to the sheet surface, with a predetermined mutual distance. The lateral size of the original can be identified if the original is detected by both sensors 302, 303 or only by the sensor 303 positioned far from the plane of drawing. A more precise size detection is possible by increasing the number of the sensors. Also the longitudinal size can be identified by the duration of detection of the original by the sensor 303 or 302. A sensor 307 is provided to detect a circulation of the originals and is composed, for example, of a partition plate and a photointerrupter.

In this RDF 300, the original supplied from the stacker tray 301 to the exposure position through a sheet path 304 can be recycled to said-tray 301 through a path 305.

Also said RDF 300 is capable of a recycling document feed (RDF) mode in which a copying operation is conducted for each setting of an original on the exposure position and the originals are recycled by a number of times corresponding to the preset copy number, and an automatic document feed (ADF) mode in which the copying operation is repeated for a number of times corresponding to the preset copy number for each setting of an original on the exposure position.

More detailed function of the RDF 300 is described in the Japanese patent application 206619/1984 of the present applicant, but will not be explained further as they are not directly related to the present invention.

D. Folding Unit (400)

The folding unit 400 is capable of half-folding in which the recording sheet after image recording is folded at the approximate center, and Z-folding in which the sheet is folded at two predetermined positions to obtain a Z-shaped cross section. In the folding unit 400 there are provided a flapper 401 for guiding the sheet downwards in the folding mode; transport paths 403, 405; and rollers 401, 409.

When the Z-folding mode is designated by a Z-folding key to be explained later, the flapper 401 is shifted to guide the recorded sheet to a lower path 403, and, when the front end of the sheet is stopped at the end of the path 403, the end of the sheet of which $\frac{1}{4}$ is folded by the roller 407 is then stopped by the end of the path 405, whereby the sheet is folded again into half. Thus the sheet is guided through the rollers 407 and 409 to the finisher unit 500. On the other hand, when the half-folding is designated by a half-fold key, the recorded sheet is folded into half in the path 403, and, without entering the path 405, discharged through roller 409 to the finisher unit 500. In case the folding mode is not selected, the flapper 401 is placed in the off state whereby the recorded sheet is directly advanced to the finisher unit 500.

E. Finisher (500)

The finisher unit 500 for sorting or stapling is provided with a flapper 501 for selecting a sorting path 503 or a stapling path 505; a stapling tray 507 for temporarily storing the sheets to be stapled; a lateral aligning plate 509 provided on the stapling tray 507; a stapler 511 for stapling plural recorded sheets aligned laterally by the aligning plate 509; a stacker tray 513 for storing the stapled sheets; and a sorting tray 515 for sorting the sheets not to be stapled. The lateral aligning plate 509 is driven by an unrepresented stepping motor.

The recorded sheets ejected from the copying machine 100 or the pedestal 200 is half-folded or Z-folded in the folding unit 400 according to a key entry, and is discharged to a movable sorting tray 515 or the stapling tray 507 of the finisher unit 500. The sheets supplied to the stapling tray 507 are laterally aligned by the plate 509, and a designated number of sheets is bound by the stapler 511 and dropped to the stacker tray 513.

As explained above, when the stapler mode is selected to a stapler key to be explained later, the finisher unit 500 shifts the flapper 501 to discharge the recorded sheets through the path 505 to the stapling tray 507, and, when the number of sheets reaches a predetermined number, activates the aligning plate 509 and the stapler 511 to staple said recorded sheets, according to an instruction from the copying machine. Then the stapled sheets are dropped to the stacker tray 513. Plural copies of collated and stapled documents are obtained in this manner, by the repetition of the above-explained sequence.

On the other hand, if the stapling is not selected, the flapper 501 is turned off to the sorting side, whereby the recorded sheets are discharged, through the path 503, to the sorting tray 515. The sheets can be stacked in positions lateral displaced by 30 mm in convenient units, in response to an instruction the copying machine 100.

FIGS. 17(A) to 17(D) show an example of an operation panel provided in the copying machine 100. Said operation panel is provided with keys 600 and displays 700 as will be explained in the following.

F. Keys (600)

In FIG. 17 there are provided an asterisk (*) key 601 used in modes for setting a stapling margin or a size for erasing the frame of the original; all reset key 602 to be actuated for restoring a standard mode; and a pre-heat key 603 for pre-heating the copying machine 100 or cancelling the pre-heating, or shifting the automatic shut-off state to the standard mode.

A copy start key 604 is actuated for starting a copying operation.

A clear/stop key 605 functions as the clear key in the stand-by state, or the stop key during a copying operation. The clear key is used for cancelling the already set copy number, or cancelling the asterisk (*) mode. The stop key is used for interrupting a continuous copying operation, which is interrupted after the completion of a copying cycle which is in progress when said key is depressed.

Numeral keys 606 are used for setting the number of copies, or setting the asterisk (*) mode. A memory key 607 is used for registering modes frequently used by the operator.

Copy density keys 608, 609 are used for manual adjustment of the copy density. An automatic exposure (AE) key 610 is used for automatic copy density control according the original density, or for changing the density control from the automatic (AE) mode to the manual mode. A cassette selector key 611 is used for selecting an upper cassette 151, a middle cassette 153 or a lower paper deck 201, or an automatic paper cassette selection mode when the originals are placed on the RDF 300. In said mode a cassette of the same size as that of the original is automatically selected.

A same size key 612 is depressed in case of same-size copying. An automatic size change key 613 is depressed in case of automatically enlarging or reducing the original image according to the size of a designated recording sheet. Zoom keys 614, 615 are used for designating an arbitrary image magnification within a range from 64 to 142%. Specified size change keys 616, 617 are used for image enlargement or reduction to certain specified sizes.

A two-side key 618 is depressed in case of forming two-sided copies from one-side originals, two-sided copies from two-sided originals, or one-sided copies from two-sided originals. A stapling margin key 619 is used to form a stapling margin of a designated width at the left-hand side of the recording sheets. A photograph key 621 is depressed in case of copying a photograph original. A multiple record key 621 is used for synthesizing the images of two originals on a same side of the recording sheet.

An original frame erasing key 622 is used in case of erasing the frame of the originals of certain specified sizes, and the original size in this case is set by the asterisk key 601. A sheet frame erasing key 623 is used for erasing the original frame according to the cassette size.

A consecutive page copying key 624 is used for copying left and right pages of the original on separate sheets.

A stapler key 625 is used for stapling the recorded sheets. A Z-fold key 626 is used for Z-folding an A3- or B4-sized sheet. A half-folding key 627 is used for half-folding an A3- or B4-sized sheet.

A sorting key 628 is used for conducting automatic sorting when the sorting tray 515 is connected. If the sorting mode is selected while the sorting tray is not connected, the RDF conducts the aforementioned recycling document feeding mode. Said mode is selected in the standard mode and indicated by an indicator. The cancellation or selection of the sorting mode can be achieved by said key 628. A grouping key 629 is used for obtaining plural copies from each original, and, if the sorting tray 515 is connected, sorting thus obtained copies in the tray 515, into groups, wherein each group contains the copies obtained from a same original. An interruption key 630 is used for interrupting a continuous copying operation and effecting another copying operation.

G. Displays (700)

In FIG. 17, a liquid crystal message display unit 701 can display a message of 40 characters, each composed for example of 5×7 dots. Said display unit is semi-transparent and is backlighted in two color. In normal state it is backlighted with green light, but is backlighted with orange light in case of an abnormality or in case the copying operation is disabled.

An image magnification display unit 702 displays the image magnification in %, set by the zoom keys 614, 615 or by the magnification change keys 616, 617. A same-size indicator 703 is lighted in case the same-size copying mode is selected. A color developer indicator 704 is lighted when a developing unit for sepia color is mounted. A copy number indicator 705 displays the copy number or codes of self diagnosis. A used cassette indicator 706 indicates the selected one of the upper cassette 151, middle cassette 153 or lower deck 201.

An original direction indicator 707 indicates the setting direction of the original. An AE indicator 708 is lighted when the automatic density control mode is selected by the AE key 610. A preheat indicator 709 is lighted in the pre-heating state, and flashes in the auto shut-off state. A ready wait indicator 710, composed of a green/orange two color LED, is lighted green in the copy enabled state but is lighted orange in the waiting state when the copying operation is not possible.

A two-side copy indicator 711 is lighted in the mode of obtaining two-sided copies from two-sided originals, or in the mode of obtaining two-sided copies from one-sided originals.

In the standard mode with the RDF 300, conditions are set for a single sheet copying, automatic density control mode, automatic sheet selection, same-size copying and one-sided copy from one-side original. In the standard mode without the RDF 300, conditions are set for a single sheet copying, manual density control mode, same-size copying and one-side copy from one-side original. The former or the latter is selected according to whether the originals are set on the RDF 300.

H. Control Unit (800)

Figure 18:
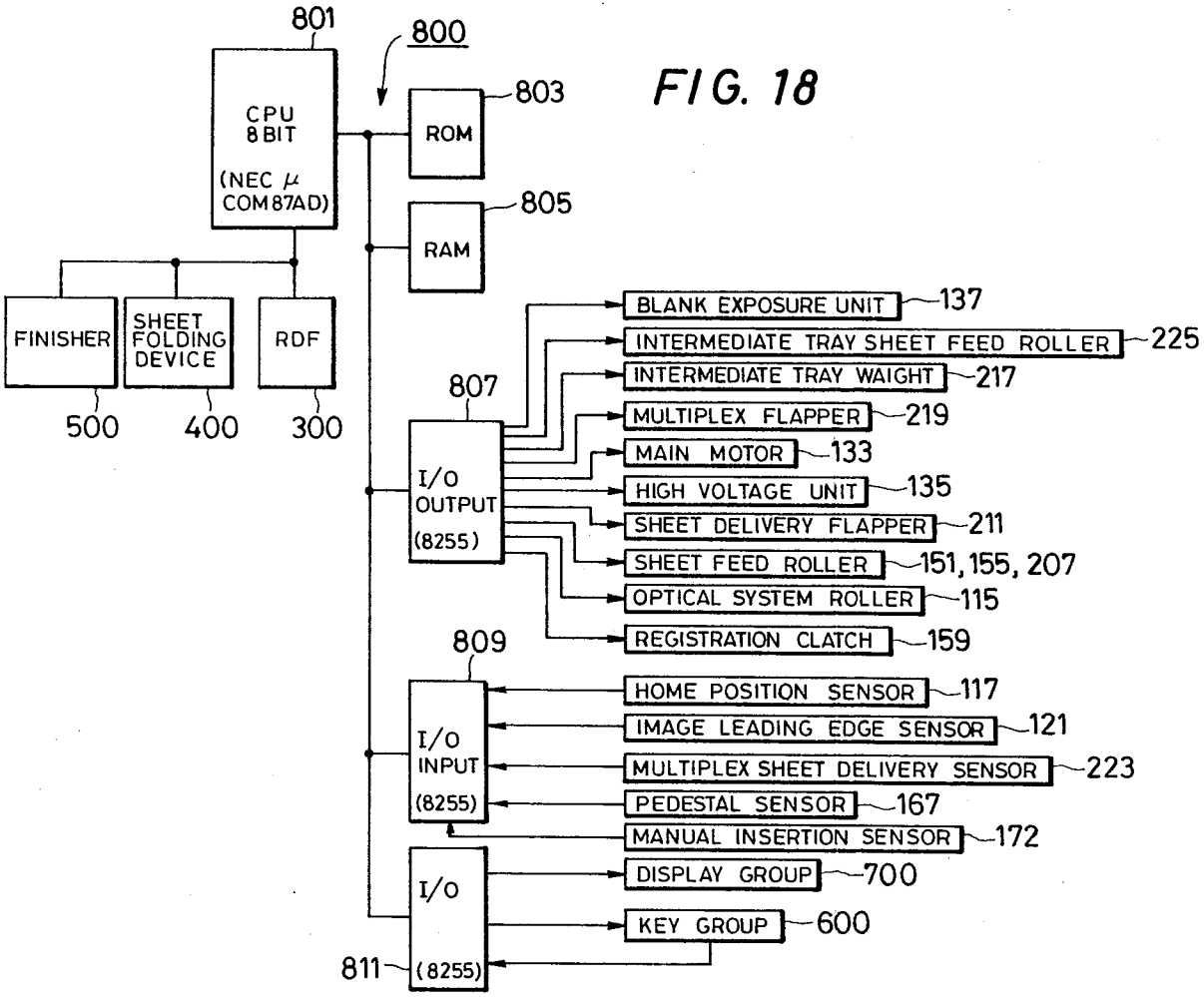
FIG. 18 is a block diagram of a control unit for the apparatus shown in FIG. 16.
Figure 19:
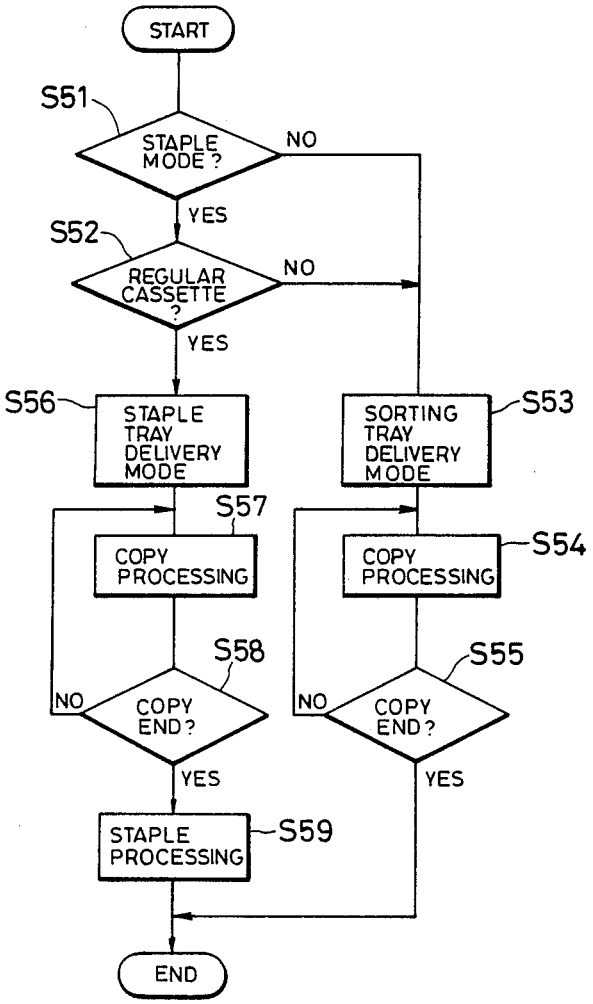
FIG. 19 is a flow chart of the control sequence for discharging sheets to sorting trays in case the size of recording sheets is not fixed.

FIG. 18 is a block diagram of the control unit 800 shown in FIG. 16. A central processing unit (CPU) 801 for effecting the control according to the present invention, is composed, for example, of a microcomputer μCOM 87AD manufactured by NEC. A read-only memory (ROM) 803 stores a control program as shown in FIG. 19, and the CPU 801 controls various component units through a bus, according to said stored control program. A random access memory (RAM) 805 is used for storing input data and as a work memory area.

There are further shown an interface (I/0) 807 for supplying the control signals from the CPU 801 to various loads such as the main motor 133; an interface 809 for transmitting the input signals from an image front end sensor 121, manual feed sensor 172 etc. to the CPU 801; and an interface 811 for controlling the inputs and outputs of the keys 600 and displays 700. These interfaces 807, 809, 811 can for example be composed of an input/output port μPD8255 manufactured by NEC.

The displays 700 corresponds to the indicators shown in FIG. 17 and are composed of light-emitting diodes, liquid crystal displays etc. Also the keys 600 correspond to the keys shown in FIG. 17, and the CPU 801 can identify the actuated key through a known key matrix.

Now reference is made to a flow chart shown in FIG. 19, for explaining the function of the present embodiment. In the present embodiment the sheets are discharged to the sorting tray even when the stapler mode is selected, if the size of the recording sheet is unfixed, as in the case of manual sheet feeding.

The operator can start a control sequence shown in FIG. 19, for example by selecting the stapler mode with the stapler key 625 in FIG. 17, then selecting a cassette for an unfixed sheet size with the cassette selecting key 611 or setting recording sheets on the manual feed tray 171 to select the manual feed mode, and depressing the copy start key 604.

At first a discrimination is made whether the stapler mode is selected, and, if not (step S51), the sorting tray mode is identified so that the flapper 501 is shifted toward the path 503 for discharging the recorded sheets to the sorting tray 515 (step S53). Then conducted is a copying operation as already explained in relation to FIG. 16 (step S54). Then discriminated is whether the recording operation has been completed, and, if completed (step S55), the sequence is terminated and the program returns to an unrepresented main routine.

If the step S51 identifies the stapler mode, the program proceeds to a step S52 for discriminating whether a cassette of fixed size is selected. If a cassette for sheets of unfixed size or a manual feed mode is selected, the program proceeds to the step S53 in the same manner as explained above-, thereby effecting a copying operation with the sorting tray mode (steps S54, S55).

Thus, if the operator selects the cassette for unfixed sizes or the manual sheet feeding in combination with the stapler mode, said stapler mode is ignored and the obtained sheets are discharged to the sorting tray 515. In such case it is also possible to cause the sorting tray 515 to effect a sorting operation.

On the other hand, if a cassette of fixed size is selected in combination with the stapler mode, the discrimination in the step S52 turns out affirmative whereby the program proceeds to a step S56 for assuming the stapling tray mode, in which the flapper 501 is shifted to the stapling tray path 505, in order to discharge the sheets to the stapling tray 507. Then a coping operation is conducted (step S57), and there is conducted a discrimination whether the copying operation has been completed. If completed (step S58), the stapler 511 is activated to bind the plural recording sheets on the stapling tray 507 with a staple, then the stapled sheets are dropped onto the stacker tray (step S59), and the program returns to an unrepresented main routine.

As explained above, in case a cassette for sheets of unfixed sizes or a manual sheet feeding is selected in combination with the stapler-mode, the present embodiment enables the image recording, disregarding said stapler mode and discharges the recorded sheets to the sorting tray without stapling, thereby avoiding the inconvenience of the operator.

Figure 20:
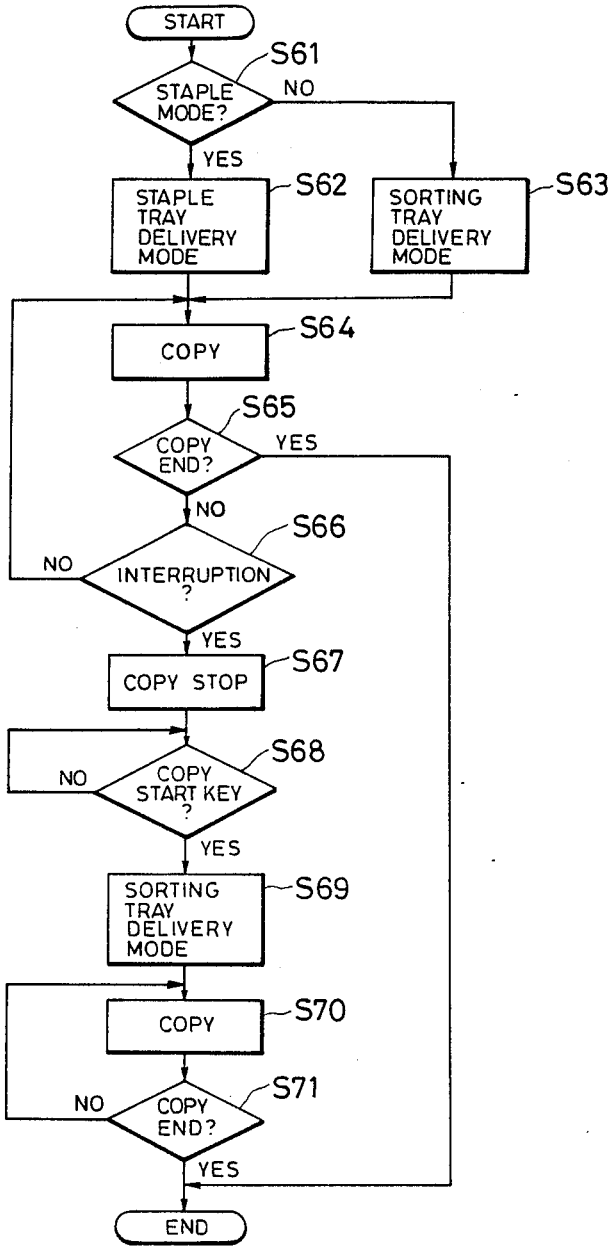
FIG. 20 is a flow chart of the control sequence for discharging sheets to sorting trays in case of the interruption copy mode.

It is also possible to prohibit the stapler mode in an interruption copying operation and to discharge the recording sheets to the sorting tray. FIG. 20 shows a flow chart showing the control sequence in such embodiment.

When the copy start key 604 in FIG. 17 is depressed by the operator, a step S61 discriminates whether the stapler mode has been selected, and, if selected, a step S62 shifts the flapper 501 to the path 505 in order to discharge the recorded sheets to the stapling tray 507. Subsequently a step S64 effects a copying operation, and a step S65 discriminates whether the copying cycles of a preset number have been completed. If not completed, a step S66 discriminates whether the interruption key 630 has been actuated, and, if actuated, a step S67 interrupts the above-mentioned copying operation. Then, in response to the depression of the copy start key 604 (step S68), a step S69 shifts the flapper 501 to the path 503 in order to discharge the sheets to the sorting tray 515. Subsequently a step S70 effects a copying operation, and the interruption copy process is terminated when a step S71 identifies the completion of the copying process.

Thereafter the mode prior to the interruption, for example the stapling tray discharge mode, is restored, thereby enabling the continuation of the remaining copying process. On the other hand, if the step S61 identifies that the stapler mode is not selected, the program proceeds to a step S63 to select the sorting tray discharge mode, in which the flapper 501 is switched to the path 503 for discharging the sheet to the sorting tray 515. Then the step S64 effects the copying process. On the other hand, if the copying operation in the step S64 is completed without the actuation of the interruption key 630, the program returns to an unrepresented main routine to await a next actuation of the copy start key 604. It is also possible, in the interruption copying operation, to cause the sorting tray 515 to conduct the sorting operation by a movement of said tray.

In this manner as interruption copying operation is enabled even during the stapler mode, thereby reducing the inconvenience for the operator.

Figure 21:
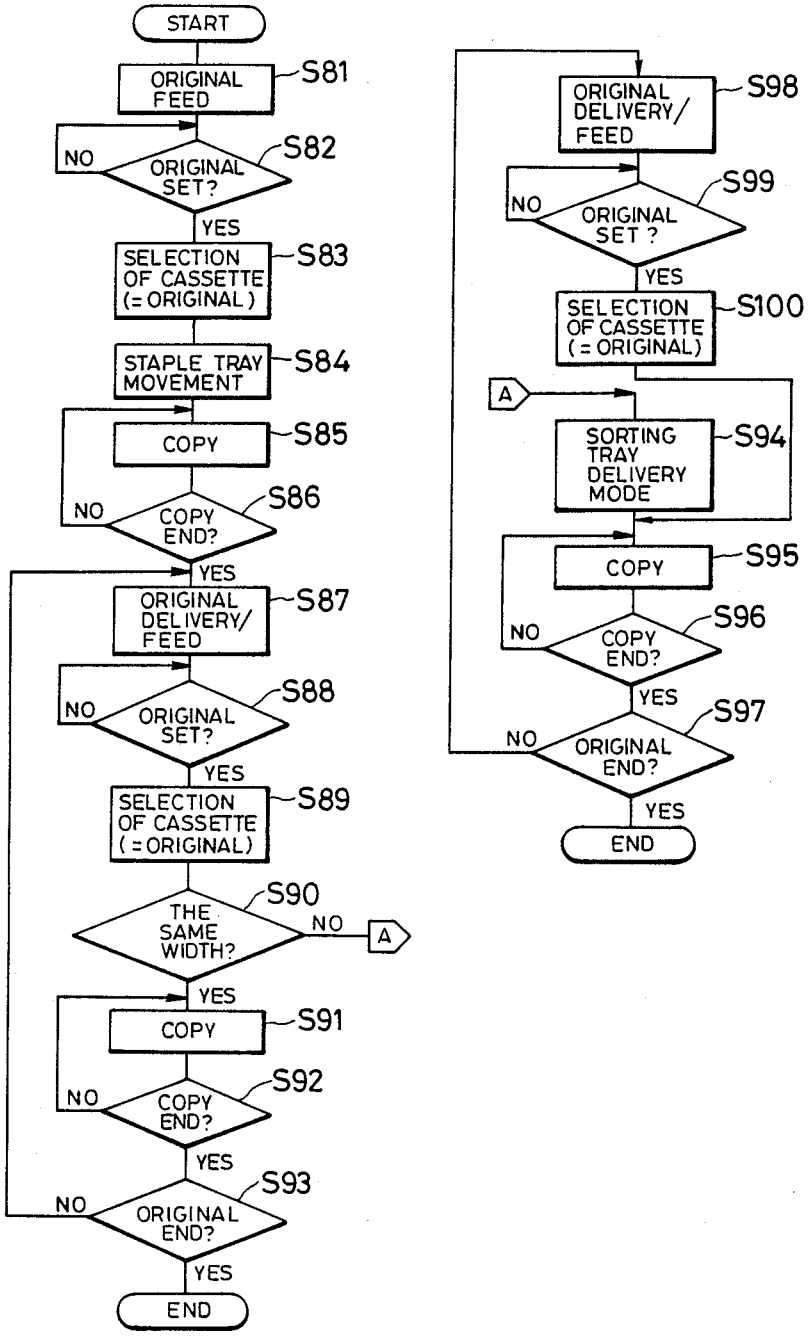
FIG. 21 is a flow chart of the control sequence, in case the sheet width is varied in the course of a copying operation, for discharging the sheets after said change to the sorting trays.

It is furthermore possible, in an apparatus with the APS (auto paper size) function in which the recording sheet is selected according to the detected original size, if the size of the recording sheet is changed in the course of a copying operation with the finisher unit in the stapling mode, to store the sheets discharged to the finisher unit after said change into the sorting tray. FIG. 21 shows a flow chart representing the control sequence in such embodiment.

When the operator sets two or more originals on the stacker tray 301 of the RDF 300 shown in FIG. 16 and actuates the stapler key 625, same-size key 612 and copy start key 604, the CPU 801 releases a control signal to cause the RDF 300 to feed the originals (step S81), and a step S82 discriminates whether an original is set at the exposure position on the glass 101 of the copying machine 100. Said original setting to the exposure position is conducted by activating a timer at a predetermined time after the original feeding and terminating the feeding operation upon expiration of the time of said timer, and said setting is discriminated by the expiration of said timer. If the original is set, a step S83 selects a cassette 151 or 153 or the deck 201 holding the sheets of a size same as that of the original detected in the course of sheet transportation. This selecting operation is hereinafter called APS (automatic paper selection) process.

Then a step S84 moves the aligning plate 509 of the finisher unit 500 according to the lateral size of the sheet of the selected cassette 151 or 153 or of the deck 201. A step S85 effects the copying operation, and, when a step S86 identifies the completion of the copying operation, a step S87 discharges the original and feeds a next original.

A step S83 then discriminates whether the next original has been set at the exposure position on the glass 101, and, if the originals are set already, a step S89 selects a cassette 151 or 153 or the deck 201 of a sheet size same as that of the original. A step S90 discriminates whether the lateral width of the recording sheet in thus selected cassette is same as that of the sheet of the cassette selected previously, and, if they are mutually equal, steps S91 and S92 repeat the copying and stapling until the copying operation is completed for the original set at the exposure position. Then the steps S87 to S93 are repeated until the copying operation is completed for all the originals set in the RDF 300. The RDF 300 is provided with a sensor for detecting a full circulation of all the original documents, and the completion of copying operation on all the original documents is discriminated by the output of said sensor.

On the other hand, discrimination in said step S90 turns out negative, indicating that the width of the recording sheet supplied from the cassette is different from the previously identified value, the selection of a non-standard recording sheet is identified and the program proceeds to a step S94 for assuming the sorting tray discharge mode, in which the flapper 501 of the finisher unit 500 is switched to the sorting tray 507. Subsequently the copying operation is repeated until the present copy number is reached (steps S95, S96). Thus, when a step S97 identifies that the copying operation for all the originals on the RDF 300 is not yet complete, a step S98 discharges the original and feed a next original, and, when a step S99 identifies the setting of said next original at the exposure position on the original supporting glass 101, a step S100 selects the cassette 151 or 153, or the deck 201 of a size same as the original size. Subsequently the above-explained steps S95 to S97 are repeated.

In discharging the recording sheet to the sorting tray 515 in the copying operation of the step S98, it is also possible to effect a sorting operation by the movement thereof.

In the present embodiment the discrimination of the selection of a non-standard recording sheet is made by a comparison with the previously selected cassette size, but it is also possible to achieve such discrimination through the comparison of the original size on the RDF.

As explained in the foregoing, in case the recording sheets of non-standard size are selected in the course of a stapler mode, such recording sheets are not stored in the stapling tray but in the sorting tray, so that the recording operation can be continued without interruption.

Figure 23:
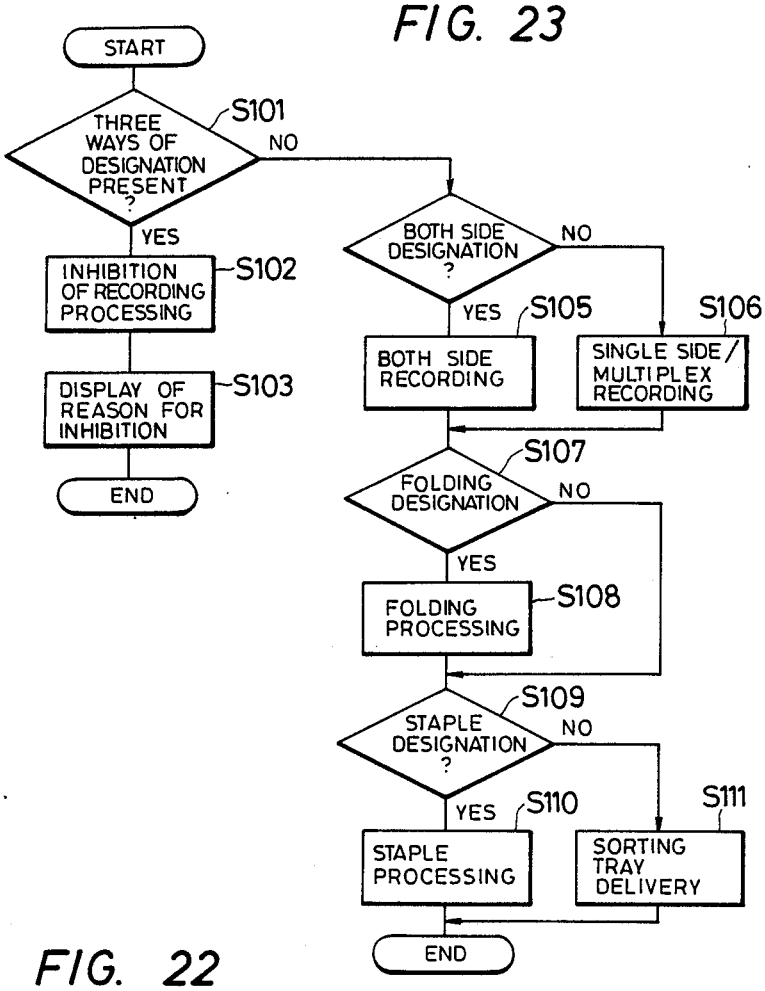
FIG. 23 is a flow chart showing the control sequence for disabling simultaneous selection of the half-folding mode, two-side copy mode and stapling mode.
Figure 22:
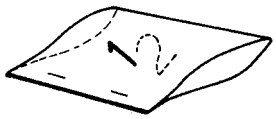
FIG. 22 is a schematic view of a sheet in case a half-folding mode, a two-side copy mode and a stapling mode are simultaneously selected.

If the half-folding mode or the stapling mode is selected in the course of a two-side copying operation, there will result unusable stapled two-side copies as shown in FIG. 22. Such unnecessary waste can be prevented by an embodiment of which control sequence is shown in the flow chart in FIG. 23. In said embodiment the image recording operation is prohibited if the two-side recording, half-fold mode and stapler mode are simultaneously selected.

In response to the actuation of the copy start key 604 by the operator, a step S101 discriminates whether the two-side recording mode, half-fold mold and stapler mode are simultaneously selected, and, if selected, the program proceeds to a step S102 to prohibit the image recording in the copying machine 100 and to display a message indicating the fact or the reason of such prohibition on a message display unit 701, and program returns to an unrepresented main routine or a stand-by routine.

When the copy start key 604 is actuated again after the two-side recording mode is changed to the one-side recording mode or the multiple recording mode, or the stapler mode or the half-fold mode is cancelled by means of the keys in the key group 600, the step S101 provides a negative discrimination, whereby the program proceeds to steps S104–S111 for usual image recording and post-process.

As explained above, the image recording is prohibited when the copy start key 604 is depressed after the stapler key 625, half-fold key 627 and twoside key 618 are depressed. It is therefore rendered possible to prevent erroneous stapling as shown in FIG. 22, wherein the information on the rear side of sheet (broken-lined numeral "2" in FIG. 22) cannot be properly observed.

Figure 24:
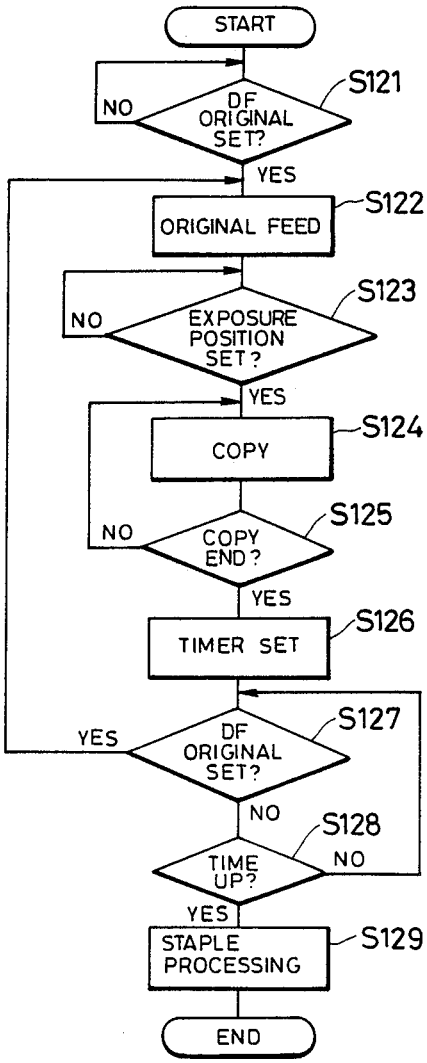
FIG. 24 is a flow chart showing the control sequence for a stapling process upon expiration of a timer.

Instead of the RDF shown in FIG. 16, in which plural original documents are set therein and are fed in succession, there is often employed a document feeder (DF) in which plural original documents are manually set one by one, are supplied to the exposure position and ejected after the exposure. FIG. 24 shows a flow chart of the control sequence of an embodiment which is capable of achieving the stapling process with a suitable timing even when such document feeder is employed.

At first the operator sets the original document, then sets the copy number "1" by the numeral keys 606, selects the stapler mode by the stapler key 625, and depresses the copy start key 604. In response a step S121 discriminates whether the original document is set, and, if already set, a step S122 start the automatic feeding of the original. Subsequently a step S123 discriminates whether the original is set at the exposure position of the glass 101, and, if set, a step S124 executes the copying operation. When a step S125 identifies the completion of a copying cycle, a step S126 activates an unrepresented internal timer of the CPU 801 for measuring a predetermined time. Then a step S127 discriminates whether a new original is set, and, if set, the program returns to the step S122 to repeat the steps S122 to S127.

On the other hand, if the step S127 identifies that a new original is not yet set, a step S128 discriminates whether said timer has expired, and, if not, the program returns to the step S127 to repeat the discrimination of the original setting on the document feeder. Thus the copying operation is repeatedly executed if the original is set within the time determined by the timer.

On the other hand, if the original is not set within said predetermined time measured by the timer, the step S128 identifies the expiration of said time, whereupon a step S129 binds the recording sheets discharged to the stapling tray 507 with the stapler 511 and drops thus bound sheets to the stacker tray 513.

Said time to be measured by the timer may be rendered variable by the numeral keys 606, according to the operating condition or requirements of each operator.

The above-explained embodiment thus enables stapling operation at a suitable timing, using an automatic original feeder for one-by-one original feeding.

Figure 25:
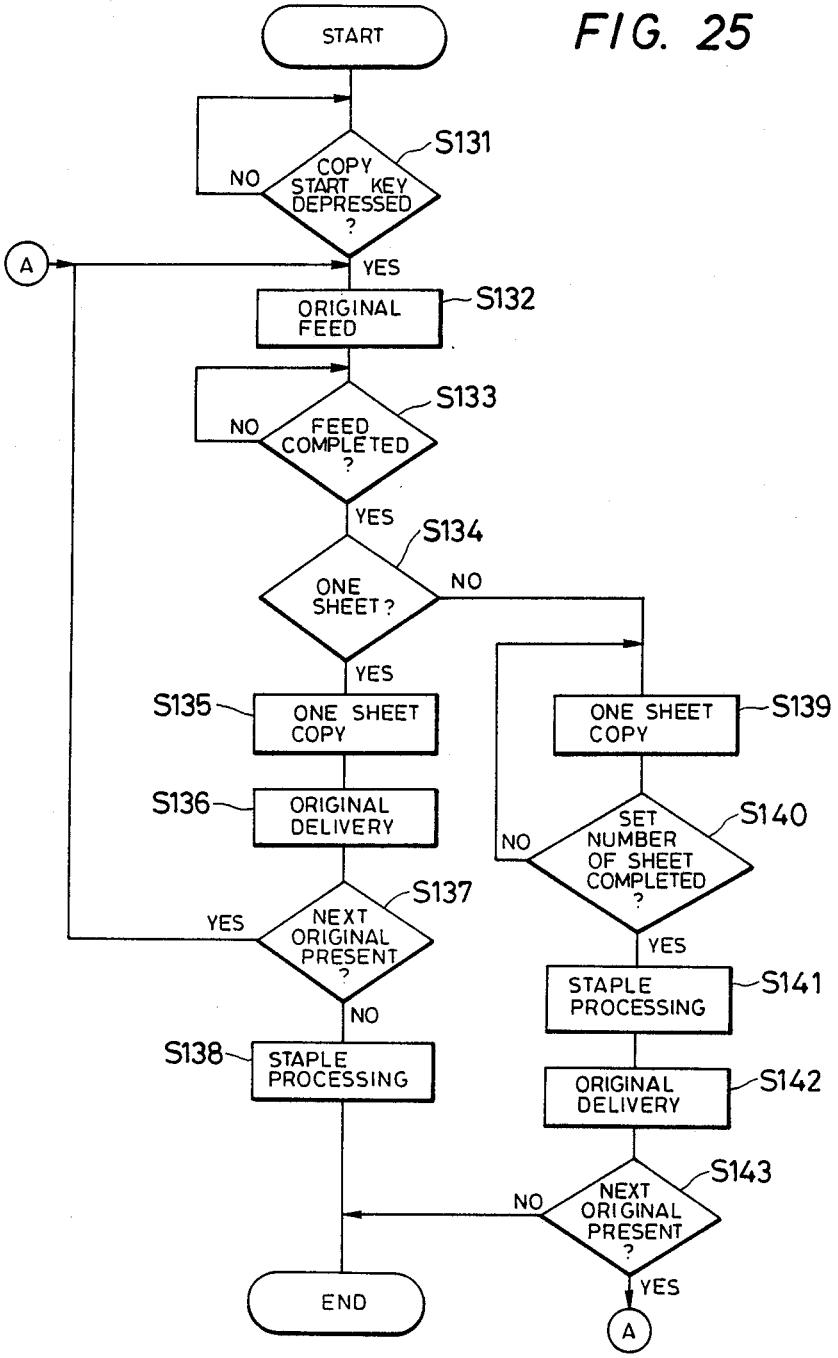
FIG. 25 is a flow chart showing the control sequence for controlling the timing of stapling process according to the preset copy number.

It is also possible to control the timing of stapling process according to the number of sheets, and FIG. 25 shows a flow chart for achieving such control.

In this case the operator does not select the sorting mode, sets the original documents on the stacker tray 301 of the recycling document feeder (RDF) 300 and selects the stapler mode with the stapler key 625.

In response to the actuation of the copy start key 604 in a step S131, a step S132 supplies a control signal to the RDF 300 for feeding an original to an exposure position of the glass 101, and, when a step S133 discriminates the completion of the original feeding, a step S134 discriminates whether the preset copy number, determined in advance by the numeral keys 606, is "1".

If said number is "1", a step S135 executes a copying operation by image reading and image recording, and a step S136 discharges the original on the glass 101 by the RDF 300. Then, if a step S137 identifies a next original on the RDF 300, the program returns to the step S132 to repeat the steps S132 to S137. When the originals on the RDF 300 are exhausted, a step S138 binds the recording sheets discharged to the stapling tray 507 with the stapler 511 and drops the bound sheets onto the stacker tray 513, whereupon the process is terminated.

On the other hand, if the step S134 identifies that the preset copy number is "2" or larger, the program jumps to a step S139 to effect a copying operation, which is repeated until a step S140 identifies that said preset copy number is reached.

Then a step S141 executes a stapling process for binding the recording sheet discharged on the stapling tray 507 with the stapler 511 as explained before, and a step S142 causes the RDF 300 to discharge the original on the glass 101. If a step S143 identifies a next original on the RDF 300, the program returns to the step S132 to repeat the cycles of the steps S132 to S134 and S139 to S143 until the original documents on the RDF 300 are exhausted, whereupon the present sequence is terminated.

In this manner the stapling operation can be executed by the selection of the stapling mode, even when the sorting mode is not selected.

Figure 26:
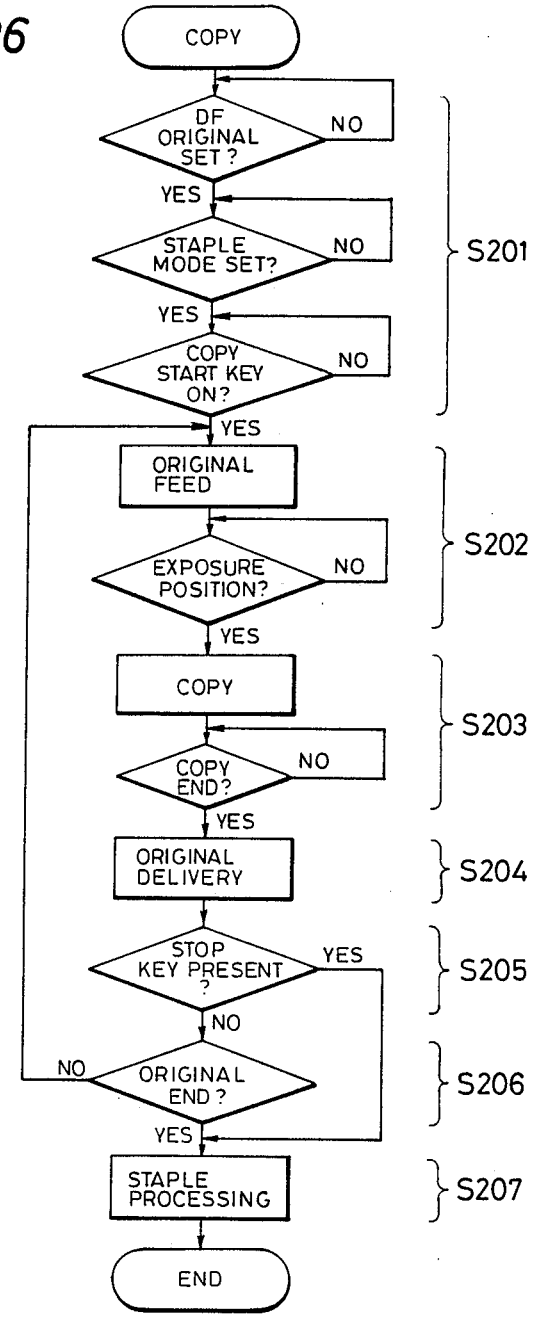
FIG. 26 is a flow chart showing the control sequence for controlling the stapling process in response to the input of the stop key.

It is furthermore possible to effect the stapling operation when the stop key is actuated, and FIG. 26 shows a flow chart for achieving such control.

The control sequence shown in FIG. 26 is initiated when the operator sets the original documents on the stacker tray 301 of the RDF 300, selects the stapler mode with the stapler key 625 and depresses the copy start key 604.

When the copy start key 604 is depressed in a step S201, a step S202 causes a control signal to be supplied to the RDF 300 thereby feeding an original to the exposure position on the original support glass 101, then, upon completion of the original feeding, a step S303 executes a copying operation consisting of image reading and image recording, and a step S204 discharges the original upon completion of said copying operation.

Then a step S205 discriminates whether the stop key 605 has been actuated during said copying operation, and, if actuated, a step S207 enables the stapling operation, after the completion of the copying operation for the original currently placed on the original support glass, thereby stapling the discharged recording sheets. On the other hand, if the stop key 605 has not been actuated, the steps of original feeding, copying operation and original discharge are repeated until the originals are exhausted (step S206), and the abovementioned stapling operation at the end of the originals, thereby terminating the sequence.

As explained in the foregoing, if the operator depresses the stop key during a copying-operation in the stapler mode, the operation is terminated by a stapling operation. Therefore the sheet after recording are not scattered and are maintained in order.

Figure 27:
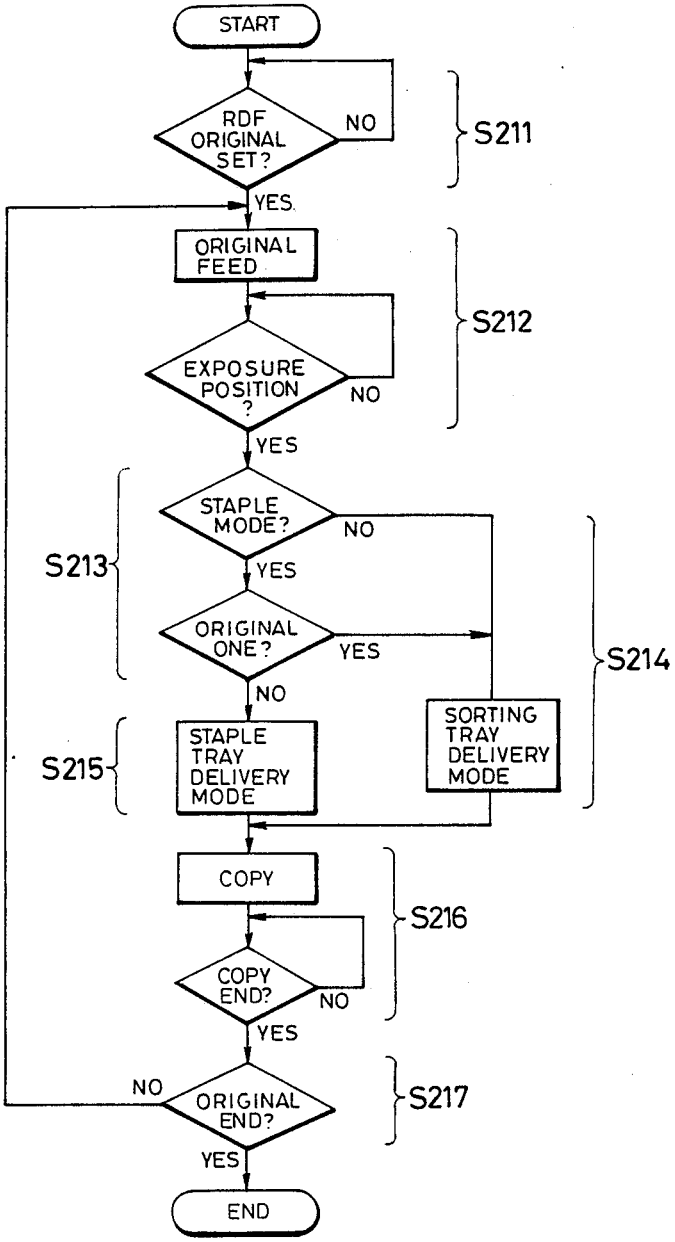
FIG. 27 is a flow chart showing the control sequence for disabling the stapling process in case only one original is present.

It is also possible not to execute the stapling operation when there is only one original document, even if the stapler mode is selected. FIG. 27 shows a flow chart for achieving such control.

The control sequence shown in FIG. 27 is started by the depression of the copy start key 604. At first a step 211 discriminates whether the originals have been set on the RDF, and, if the originals are present, a step S212 feeds an original to the exposure position. Then a step S213 discriminates whether the stapler mode is selected, and, if not, a step S214 selects the discharge mode to the sorting tray 515, thereby discharging the sheets to the sorting tray 515. On the other hand, if the stapler mode is identified in the step S213, the circulation sensor 307 of the RDF checks whether there is only one original, and the discharge mode to the sorting tray is adopted in the step S214 only if there is only one original document. In case there are two or more original documents in the stapler mode, a step S215 selects the stapling tray discharge mode in which the discharged sheets are sent to the stapling tray 507.

Then the copying operation is conducted for the above-mentioned original document, and the above-explained steps S212 to S216 are repeated until the original documents make a full circulation.

In case of the stapler mode, the stapling operation is conducted during the copying operation. Also sorting operation may be conducted in case of sorting mode.

As explained above, the stapling operation is not conducted when there is only one original document, even if the stapler mode is selected. It is therefore possible to avoid the error of stapling same copies.

Figure 28:
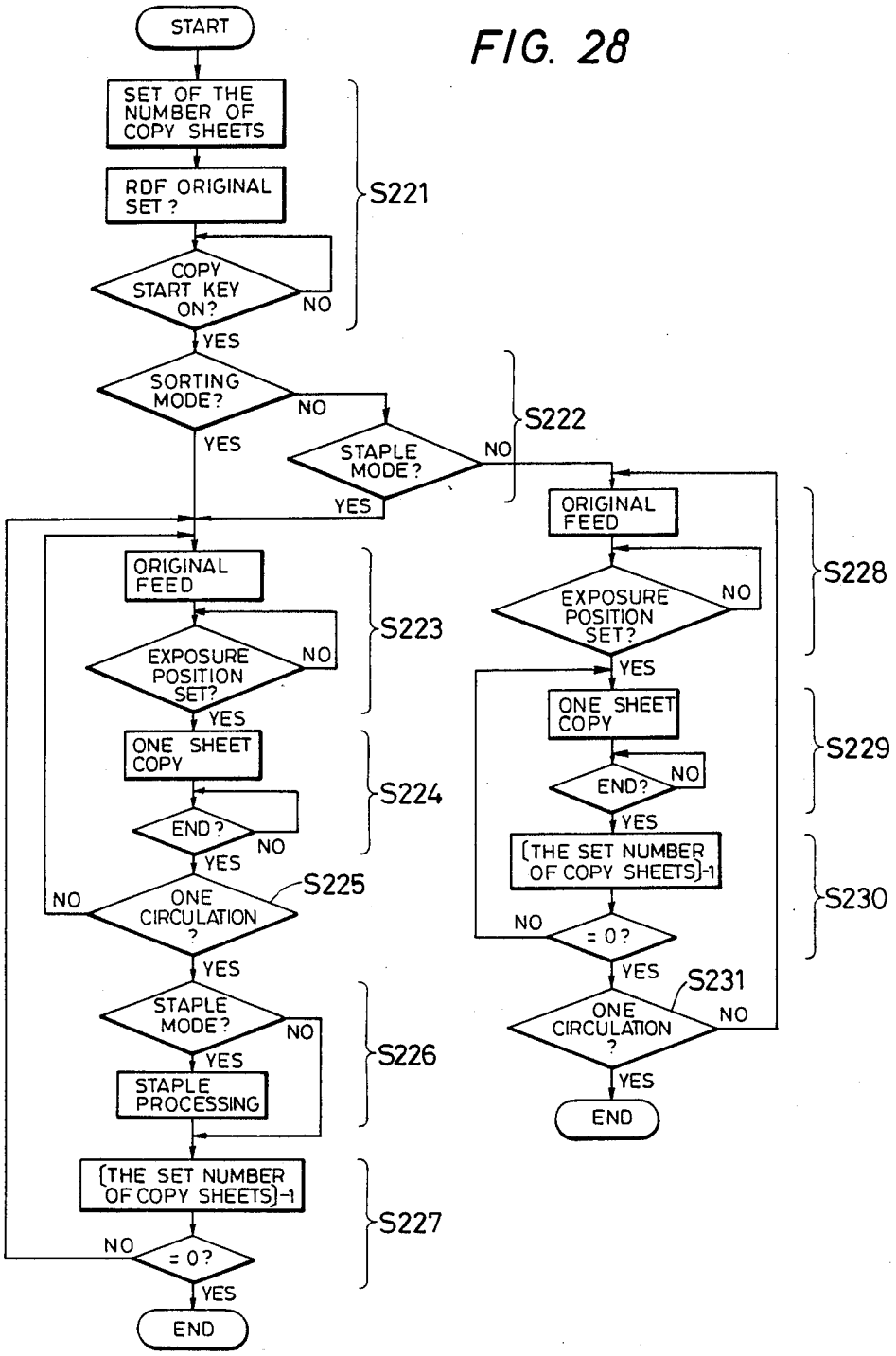
FIG. 28 is a flow chart showing the control sequence for selecting the RDF mode according to the selection of the stapling mode.

It is also possible to realize the control in such a manner that the RDF feeds an original for each exposure and repeats such feeding for a number of times equal to the preset copy number, when the stapler mode is selected. FIG. 28 shows a flow chart of the control sequence for achieving such control. Said control procedure is started by setting the copy number with the numeral keys 607, setting the original documents on the RDF and depressing the copy start key 607 in a step S221. Then a step S222 discriminates whether the sorting mode is selected by the sort key 628, and whether the stapler mode is selected by the stapler key 625, and, if the sorting mode is selected, the program unconditionally proceeds to a sorting operation, starting from a step S223. However, even when the operator forgets the selection of the sorting mode, the sorting operation starting from the step S223 is still conducted if the stapler mode is selected. The non-sorting mode starting from a step S228 is adopted only when no particular mode is selected.

The sorting operation starting from the step S223 is conducted in the following manner. At first, in a step S223, the originals set on the RDF are fed to the exposure position one by one, and, in a step S224, the copying operation is conducted once for said original. This operation is repeated until the circulation sensor detects a full circulation of the originals, thereby providing a set of coipes. In this manner the recording operation is conducted by conducting one recording for each original. After a full circulation, a step S226 conducts a stapling operation if the stapler mode is selected.

The above-explained steps S223 to S226 are repeated until a step S227 identifies that the remaining copy number has reached zero, thereby providing a preset number of sorted and stapled sets of copies.

Now there will be explained the non-sorting operation starting from a step S228. In this case a step S228 causes the RDF to feed the originals one by one to the exposure position, and steps S229 and S230 execute the copying operations by a number of times equal to the preset copy number for each original, and this operation is repeated until a step S231 identifies a full circulation of the originals.

As explained above, in the stapler mode, a copy is made from every one of plural originals, and this operation is repeated by a number of times equal to the preset copy number by circulating the originals. It is therefore rendered possible to prevent an error of stapling same copies obtained from an original document.

Figure 29:
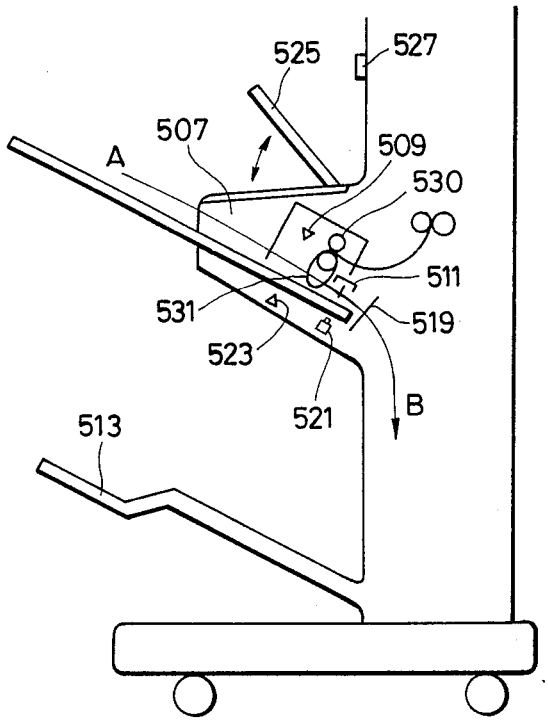
FIG. 29 is a schematic view of a stapling unit in said finisher unit.
Figure 30:
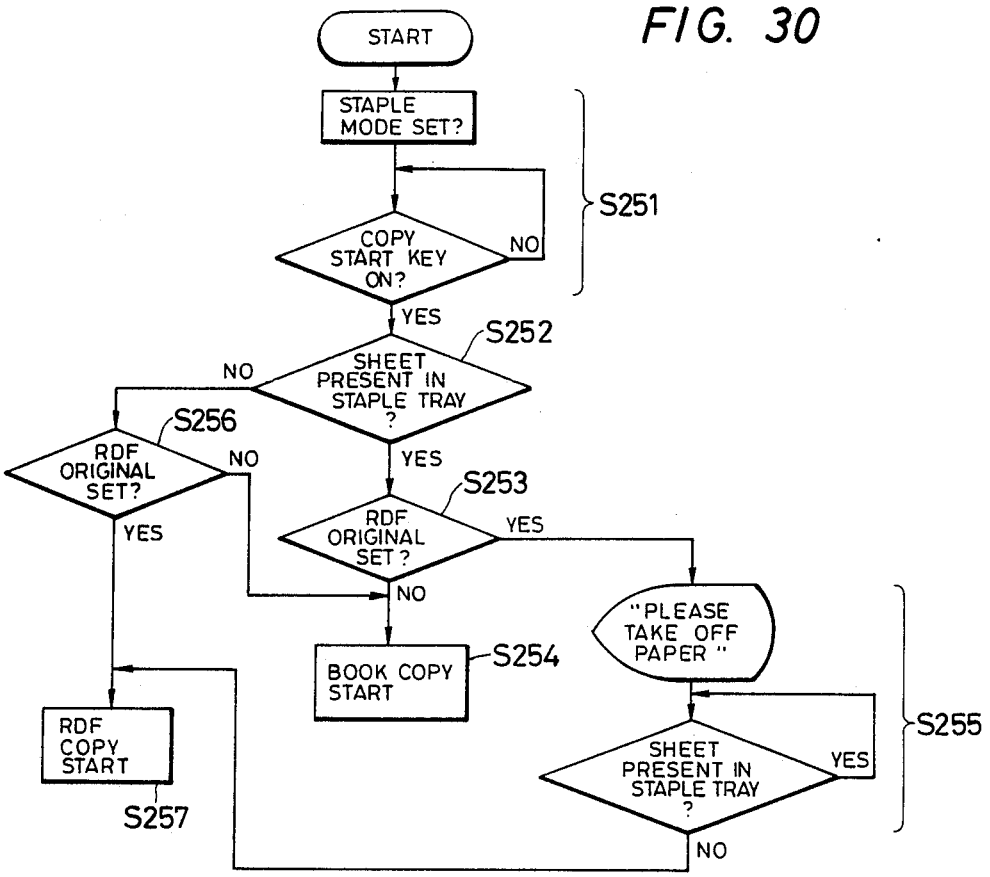
FIG. 30 is a flow chart showing the control sequence for controlling the copying operation according to a succeeding copy mode, in case sheets are present on the staple tray.
Figure 31:
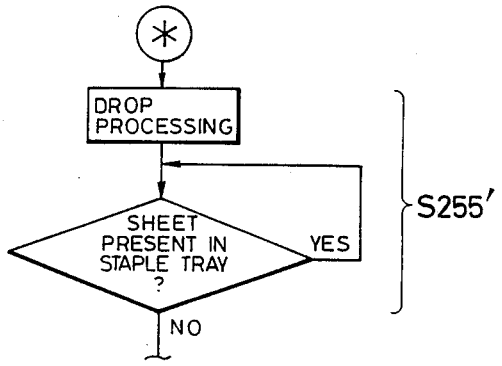
FIG. 31 is a flow chart showing a modification to that shown in FIG. 30.

It is furthermore possible to prohibit the copying operation if recording sheets are left on the stapling tray, in the copying with the stapler mode. FIG. 29 schematically shows a part of the stapler of the finisher unit, and FIGS. 30 and 31 are flow charts of the control sequence for achieving such control. Referring to FIG. 29, sheets discharged from the copying machine after recording are transported by the discharge rollers 530 and stacked on the stapling tray 507. The sheets are aligned toward the stopper 519 by the belt 531 provided on the roller 530, and also aligned laterally by the plate 509. Said sheets successively stacked on the stapling tray 507 are stapled by the stapler 511 at a predetermined point in the continuous copying operation, for example after a full circulation of the originals. After said stapling, the solenoid 521 is energized to retract the stopper 519, whereby the stapled copies are dropped from the stapling tray 507 to the stacker tray 513. A sheet sensor 523 of the stapling tray inspects said dropping, and the solenoid 521 is deactivated after a predetermined period from the detection by said sensor, i.e., after complete dropping of the sheets. The stapling operation is completed in this manner.

Said stapling tray 507 is provided with an openable cover 525 to enable insertion of sheets into the stapling tray 507 from a direction A. A manual stapling button 527 allows to staple the sheets contained in said stapling tray. In this manner the operator can utilize this equipment instead of the usual stapler in the office.

Now reference is made to FIG. 30 for explaining the function of the present embodiment. The control sequence is initiated, in a step S251, by selecting the stapler mode with the stapler mode key 625 in the operation unit and depressing the copy shaft key 605. Then a step S252 causes the sheet sensor 523 of the stapling tray discriminate the presence of sheet thereon, eventually left from the foregoing operation. If there are no sheets, the program proceeds to a step S256 to identify the presence of originals on the RDF. If the originals are present the program proceeds to a step S257 to enter a mode of automatic stapling at every full circulation of the originals from the RDF, but, if there are no originals, the program proceeds to a step S254 to enter a book copy mode in which a sheet is discharged to the stapling tray. The details of these modes will not be explained, but, in the-latter book copy mode, a sheet is discharged at each depression of the copy start key, and the operator actuates the aforementioned manual stapling button when desired copies are stacked on the stapling tray, whereby said copies are stapled and drop to the stacker tray. In this manner the copying operation is conducted without the original feeding means. Said book copy mode may employ sheet original feeding means. Said book copy mode may employ sheet originals or book originals. If the operator fails to conduct stapling by the manual stapling button in this operation, the stapling tray will still contain sheets which will be detected in the step S252.

In such case the program proceeds to a step S253 for discriminating whether the originals are set on the RDF, and, if there are no originals, the aforementioned book copy mode is adopted. On the other hand, if there are originals, the program proceeds to a step S255.

The step S255 displays a message "remove sheets of the stapling tray" and disables the operation until the operator removes the remaining sheets. A step S257 activates the RDF copying operation when the operator removes the sheets from the stapling tray, and the mixing of such remaining sheets into the succeeding stapling operation is prevented in this manner.

As another embodiment of said step S255, there may be employed a step S255 shown in FIG. 31, in which said message display is replaced by the retraction of the stopper 519, thereby dropping the sheets on the stapling tray onto the stacker tray.

As explained above, the sheets eventually remaining on the stapling tray are not mixed in the sheets to be stapled in the succeeding copying operation, by controlling the start of said succeeding operation according to the image forming mode.

Figure 32:
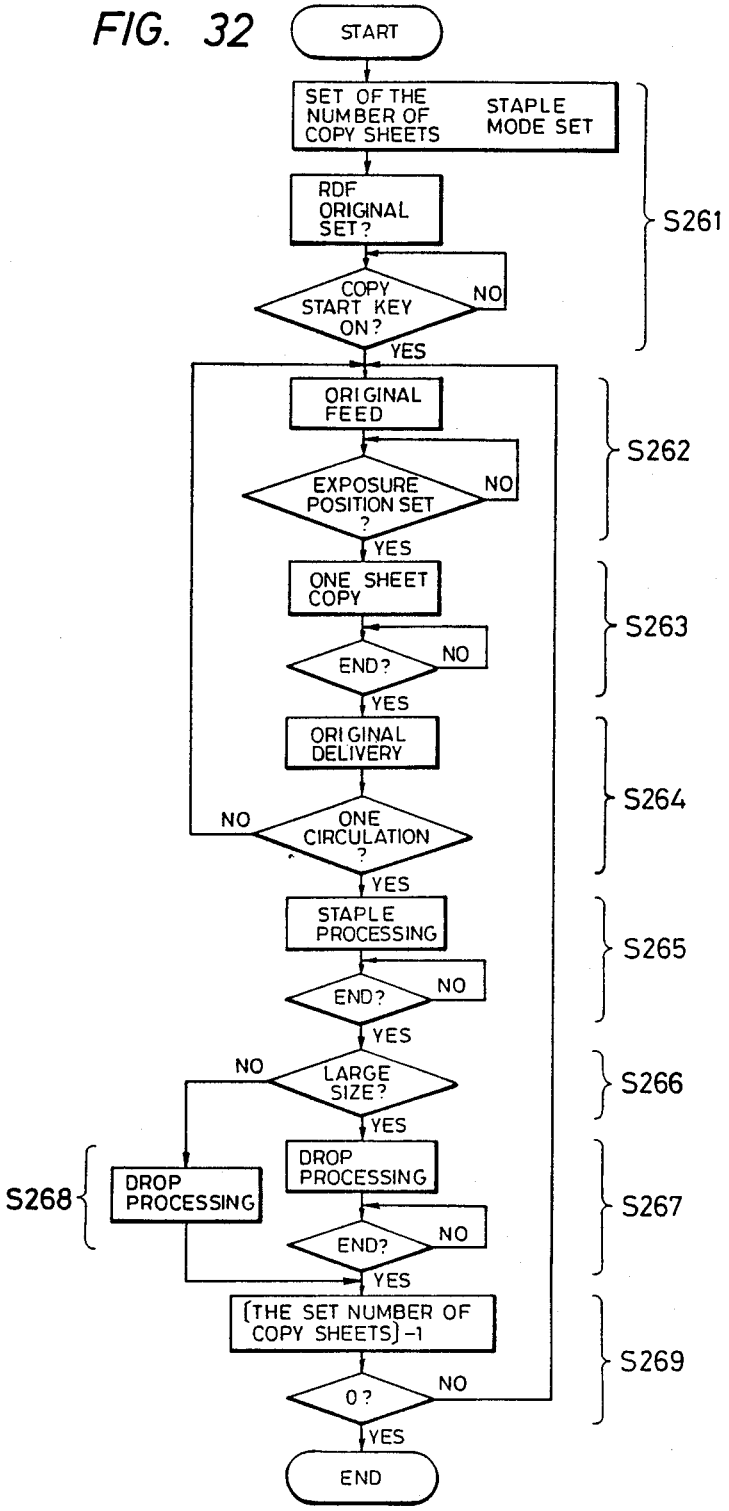
FIG. 32 is a flow chart showing the control sequence for controlling the timing of stapling process according to the size of recording sheets.

It is furthermore possible to control the timing of enabling a succeeding copying operation according to the size of the recording sheet. FIG. 32 shows a flow chart of the control sequence for achieving such control.

Said control sequence is initiated in a step S261 by setting the copy number with the numeral keys 607, selecting the stapler mode with the stapler mode key 625, setting the originals on the RDF, and depressing the copy start key 604.

At first a step S262 causes the RDF to feed the original documents one by one to the exposure position on the original support glass, and a step S263 executes a copying operation and discharges a recording sheet onto the stapling tray 507 of the finisher unit. The steps S262 to S264 are repeated until the circulation sensor 307 of the RDF detects a full circulation of the originals, whereby a set of copies are stacked on the stapling tray. At this point the apparatus once enters a stand-by state. A step S265 causes the stapler 511 to execute stapling and awaits the completion of said stapling operation. Then a step S266 identifies if the stapled copies are of a small size such as B5 or A4, or a large size such as B4 or A3 and accordingly determined the ensuing steps.

In case of the large size, the program proceeds to a step S267 for dropping the above-mentioned recording sheets from the stapling tray 507 to the stacker tray 513, and then proceeds to a step S269 after said dropping.

In case of the small size, the program proceeds to a step S268 for effecting the same dropping process as explained above, and proceeds to the step S269 without waiting the completion of said dropping process.

The step S269 instructs to repeat the above-explained procedure until the copies of the predetermined copy number are obtained, and thus defines the start timing of the succeeding copying operation.

In the following there will be explained the difference between the step S268 and the step S269. If the dropping speed of the stapled copies is maintained constant by an unrepresented transport motor, the time required for such dropping should vary according to the size of said sheets. For example, for a dropping speed of 420 mm/sec., said time is equal to 0.5 seconds in case of the A4 size (210 mm), but 1.0 second in case of the A3 size (420 mm). However, if the step S269 is executed regardless of the sheet size, the start of the succeeding copying operation will have to be delayed so that the entire throughput is evidently lowered. On the other hand, the step S268 will result in a drawback that a recording sheet obtained in the succeeding copying operation is discharged on the stapling tray 507 before the completion of the dropping process. In the present embodiment, therefore, said start timing is regulated according to the sheet size. More specifically, for the small size such as A4 size, the next copying operation is started at the start of the dropping process of the stapled copies, because the time from the start of said next copying operation to the discharge of corresponding copying sheet to the stapling tray 507 is securely longer than the time required for said dropping process, which is 0.5 seconds for the A4 size, thereby improving the entire throughput. On the other hand, in the large size such as A3 size, said time to the sheet discharge may be shorter than the timer for the dropping process, which is 1 second for the A3 size, so that said next copying operation is enabled after the completion of the dropping process. In this manner there is obtained a high reliable stapling process.

As explained above, the start timing of the image recording operation after stapling is controlled according to the size of the recording sheet, thereby minimizing the loss in the image forming speed.

Figure 33:
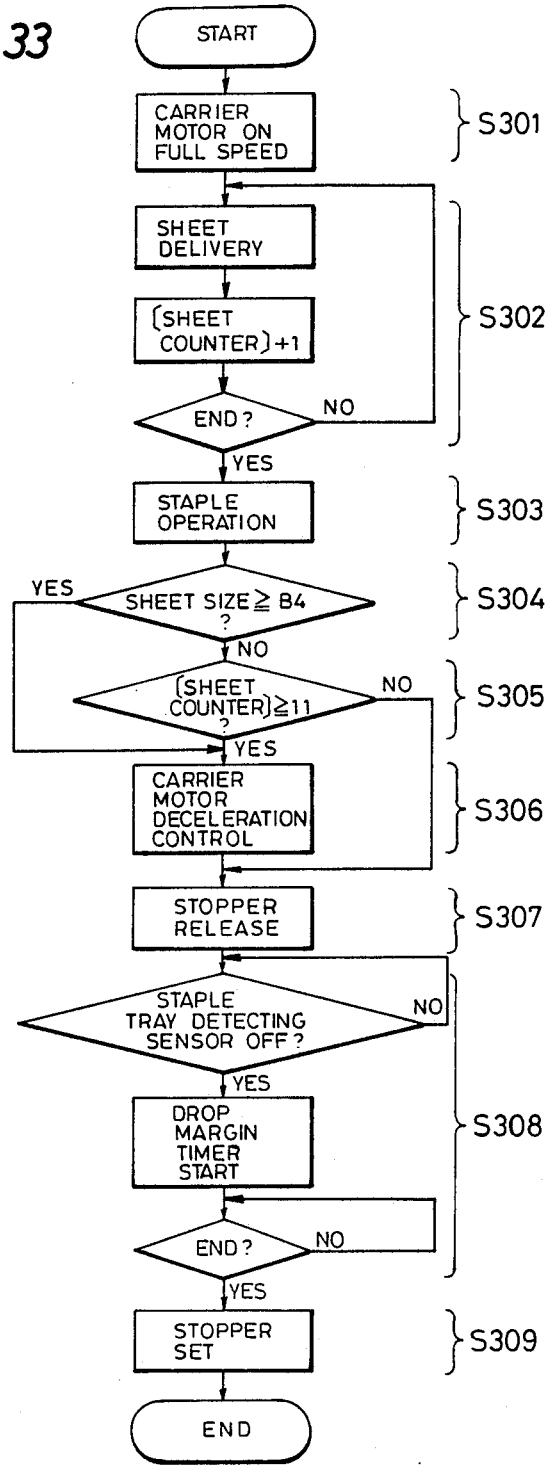
FIG. 33 is a flow chart showing the control sequence for controlling the transport speed of the sheet bundle according to the size or number of sheets.
Figure 34A:
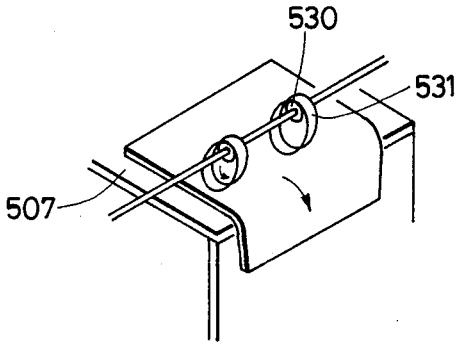
FIGS. 34A and 34B are views showing the state of transport of a sheet bundle.
Figure 34B:
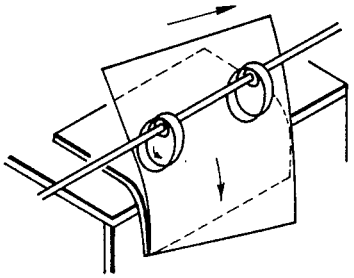

It is furthermore possible to control the transport speed according to the size or number of recording sheets when the stapled sheet bundle is dropped to the tray 513. FIG. 33 is a flow chart of the control sequence for achieving such control, and FIGS. 34A and 34B are schematic views showing the movement of the sheet bundle In this embodiment, in case of the stapler mode, a step S301 drives the transport system by activating the transport motor at full speed Then a step S302 stacks the sheets, discharged from the copying machine, on the stapling tray 507 and counts the number of said sheets by stepping a sheet counter up, until the sheet discharge is completed At said completion a step S303 activates the stapler for binding said sheets with staples. After said stapling, a step S304 discriminates whether the sheet size is larger than B4 size, and a step S305 discriminates, by said sheet counter, whether the number of sheets is equal to or larger than 11. If either discrimination turns out affirmative, a step S306 decelerates the transport motor, for example by a known method such as pulse width modulation, of which details are omitted Then a step S519 energizes a solenoid to retract the stopper 519, whereby the sheet bundle is transported by the belt 531 toward the stacker tray 513.

FIG. 34A shows the transportation of sheet bundle in normal state, but a fast transportation may result in a skewed transportation of the uppermost sheet as shown in FIG. 34B, since, if the sheets are large or if a large number of sheets are stacked, the transporting force is only transmitted to the uppermost sheet.

In such case, a lowered transport speed avoids a rapid increase in load, thus preventing such skewed transportation.

The next step S308 measures a sufficient time, with a timer, from the passing of the sheet bundle through the sheet sensor 523 of the stapling tray to the passing of the rear end of said sheet bundle through the stopper 519, and sets the stopper 519 at the expiration of said timer.

As explained in the foregoing, the transport speed of the sheet bundle from the stapling tray to the stacker tray according to the sheet size or the number of stapled sheets, thereby enabling satisfactory sheet stacking and preventing an error that a sheet is detached from the stapled sheet bundle.

Although the foregoing embodiments have been limited to the use of copying machine, the present invention is applicable also to a printer unit for use in a facsimile apparatus or an electronic file system.

What is claimed is:

1. A sheet handling apparatus comprising:
binding means for binding transported sheets;
detecting means for detecting the number of the sheets transported to said binding means; and
prohibiting means for prohibiting the binding operation when the number of sheets detected by said detecting means is one.

2. A sheet handling apparatus according to claim 1, wherein said apparatus further comprises image forming means, and wherein said binding means binds the sheet transferred from said image forming means, said binding means being adapted to execute said binding operation upon completion of image formation by said image forming means or upon detection by said detecting means that the number of sheets has reached a predetermined number greater than one.

3. A sheet handling apparatus according to claim 1, wherein said binding means comprises aligning means for aligning transported sheets.

4. A sheet handling apparatus comprising:
storage means for storing plural sheets transported thereto after discharged from a copying machine;
stapling means for binding the sheets stored in said storage means;
control means for activating said stapling means either in a first mode in which the stapling operation is conducted in response to the completion of image formation, or in a second mode in which the stapling operation is conducted arbitrarily regardless of the completion of image formation; and
input means for entering a selection signal for selecting said first mode of said second mode;
wherein said copying machine comprises a document feeding device for feeding original documents to an exposure position and discharging said original documents therefrom, and said selection signal is supplied from said copying machine according to whether said document feeding device is employed or not.

5. A sheet handling apparatus according to claim 4, wherein said control means enables the selection of said second mode in response to said selection signal when said document feeding device is not used.

6. A sheet handling apparatus comprising:
storage means for storing plural sheets transported thereto;
stapling means for binding the sheets stored in said storage means;
control means for activating said stapling means either in a first mode in which the stapling operation is conducted in response to the completion of image formation, or in a second mode in which the stapling operation is conducted arbitrarily regardless of the completion of image formation; and input means for entering a selection signal for selecting said first mode or said second mode;

wherein said control means comprises manual operation means, and said stapling means is activated in said second mode in response to an input from said manual operation means.

7. A sheet handling apparatus comprising:

storage means for storing plural sheets transported thereto;

stapling means for binding the sheets stored in said storage means;

control means for activating said stapling means either in a first mode in which the stapling operation is conducted in response to the completion of image formation, or in a second mode in which the stapling operation is conducted arbitrarily regardless of the completion of image formation;

input means for entering a selection signal for selecting said first mode or said second mode; and another storage means for storing transported sheets, wherein said control means is adapted to store the transported sheet in said another storage means if there is only one sheet transported when said first mode is selected.

8. A sheet handling apparatus comprising:

folding means for folding transported sheets;

detection means for detecting defective folding in said sheets;

binding means positioned downstream of said folding means and adapted to bind the sheets transported from said folding means; and control means for controlling the binding operation for a sheet when said detection means detects a defective folding on said sheet.

9. A sheet handling apparatus according to claim 8, wherein said binding means comprises storage means for storing the sheets transported from said folding means, and said control means is adapted to control the binding operation on the sheets in said storage means in response to an output of said detection means.

10. A sheet handling apparatus according to claim 8 or 9, wherein said control means prohibits said binding operation when said detection means detects a defective folding.

11. A sheet handling apparatus comprising:

folding means for folding transported sheets;

detecting means for detecting defective folding in said sheets;

binding means positioned downstream of said folding means and adapted to bind said sheets discharged from said folding means;

stacker means positioned downstream of said folding means and adapted for stacking said sheets discharged from said folding means;

instruction means for instructing whether to transport said sheets to said binding means or to said stacker means;

selection means positioned downstream of said folding means and adapted to select the destination of said sheets as said binding means or said stacker means according to an instruction signal from said instruction means; and control means adapted, when said detection means detects a defective folding on one of said sheets, to cause said selection means to select a path contrary to the instruction signal from said instruction means.

12. A sheet handling apparatus according to claims 11, further comprising correction means for correcting the number of sheets missing due to defective folding after the detection of defective folding by said detection means.

13. A sheet handling apparatus comprising:

first storage means with stapling function for binding sheet with a staple;

second storage means without stapling function;

selection means for selecting either said first storage means or said second storage means;

detecting means for detecting that the size of said sheet is uncertain; and control means adapted for transporting the sheets with uncertain size to said second storage means in response to the output of said detection means, even if said first storage means has been selected by said selection means.

14. A sheet handling apparatus according to claim 13, further comprising image recording means for recording an image on a sheet, wherein said first or second storage means is adapted to store the sheets discharged from said image recording means.

15. A sheet handling apparatus according to claim 14, wherein said image recording means is adapted to record an image on manually fed sheets, and said detection means is adapted, in case of said manual sheet feeding, to detect that the sheet size is uncertain.

16. A sheet handling apparatus comprising:

image recording means for recording an image on a sheet;

first storage means comprising stapling means for binding the sheets after recording with a staple;

second storage means without stapling means; instruction means for instruction, during an image recording operation, an interruption image recording operation; and control means adapted, in response to an instruction for said interruption from said instruction means, to discharge the sheets subjected to said interruption image recording to said second storage means.

17. A sheet handling apparatus according to claim 16, wherein said control means unconditionally causes the sheets to be discharged to said second storage means in said interruption image recording.

18. A sheet handling apparatus comprising:

first storage means comprising stapling means for binding sheets with a staple;

second storage means without stapling means;

selection means for selecting either said first storage means or said second storage means;

detection means for detecting, during discharge of sheets to said first storage means, whether the size of a sheet is different from that of a preceding sheet; and control means for switching sheet paths to discharge the sheets of said second storage means in response to the detection output of said detection means, even if said first storage means has been selected by said selection means.

19. A sheet handling apparatus according to claim 18, wherein said detection means is adapted to detect whether the size of a sheet in a direction substantially perpendicular to the sheet transporting direction is different from that of a preceding sheet.

20. A sheet handling apparatus comprising:

recording means adapted for recording information on both sides of a sheet in response to the selection of two-side recording;

folding means for folding the sheet discharged from said recording means, in response to the selection of half-folding;

stapling means for binding said discharged sheets in response to the selection of stapling; and control means adapted for prohibiting the recording operation in said recording means if said two-side recording, said half-folding and said stapling are simultaneously selected.

21. A sheet handling apparatus according to claim 20, wherein said folding means is capable of further half-folding a half of said sheet.

22. A sheet handling apparatus according to claim 20, wherein said recording means is capable of image recording once or plural times on a side of the sheet.

23. A sheet handling apparatus according to claim 20, further comprising display means for providing a predetermined display when the recording operation is prohibited by said control means.

24. A sheet handling apparatus comprising:

automatic document feed means for automatically feeding original documents set in advance to an exposure position, wherein said automatic document feed means is adapted to feed manually set original documents to said exposure position;

recording means for recording an image on a sheet according to the image of an original document fed to said exposure position;

stapling means adapted to store the sheets discharged from said recording means and to staple thus stored sheets; and control means adapted to activate said stapling means in case, after image formation for an original document fed by said document feed means, a next original document is not set into said document feed means within a predetermined time.

25. A sheet handling apparatus comprising:

automatic document feed means for automatically feeding plural original documents stacked on a tray to an exposure position;

detection means for detecting the presence/absence of the original document on said tray;

setting means for a desired number of recordings;

recording means for recording an image on a sheet according to the image of an original document fed to said exposure position;

stapling means adapted to store the sheets discharged from said recording means and to staple thus stored sheets; and control means for controlling the operation timing of said stapling means according to the number set by said setting means, wherein said control means is adapted to cause said stapling means to effect said stapling on condition that said detection means detects the absence of the original document on said tray if said number set by said setting means is one.

26. A sheet handling apparatus comprising:

recording means for recording an image corresponding to an original document on a sheet;

stapling means for binding sheets recorded by said recording means and stored thereafter, with a staple;

key input means for entering an interruption instruction to interrupt a recording operation before completion thereof; and control means for interrupting the recording operation and causing said stapling means to effect said stapling operation in response to the interruption instruction entered from said key input means.

27. A sheet handling apparatus according to claim 26, wherein said control means is adapted, in response to the interruption instruction entered from said key input means, to activate said stapling means after the completion of a recording operation currently in progress at the time of said instruction.

28. A sheet handling apparatus according to claim 26, further comprising automatic document feed means for automatically feeding original documents to an exposure position.

29. A sheet handling apparatus according to claim 28, wherein, in the absence of said instruction for interruption, said control means executes the original feeding by said automatic document feed means and image recording by said recording means for all the original documents, and activates said stapling means after the completion of image recording for all the original documents.

30. A sheet handling apparatus comprising:

first storage means for stacking sheets;

stapling means for binding the bundle of sheets stored in said first storage means;

second storage means for storing the stapled bundle of sheets;

transport means for moving said bundle of sheets from said first storage means to said second storage means; and control means for reducing the speed of said transport means according to the size of number of sheets stacked in said first storage means.

31. A sheet handling apparatus according to claim 30, wherein said speed reduction is executed when the size of said sheets is larger than a predetermined size.

32. A sheet handling apparatus according to claim 30, wherein said speed reduction is executed when the number of said sheets exceeds a predetermined number.

33. A sheet handling apparatus comprising:

image generating means capable of generating plural different images;

designation means for designating the number of different images generated by said image generating means;

selection means for selecting either a first mode in which sheets subjected to image formation are stapled, or a second mode in which said sheets are not stapled; and control means for controlling said selection means in such a manner, when said first mode is selected, as to switch the mode from said first mode to said second mode when said designation means designates the number one.

34. A sheet handling apparatus according to claim 33, wherein said first mode utilizes a discharge tray provided with stapling means for stapling sheets, and said second mode utilizes a discharge tray not provided with such stapling means.

35. A sheet handling apparatus according to claim 33, wherein said image generating means is automatic document feed means for automatically feeding original documents to an exposure position.

36. A sheet handling apparatus according to claim 35, wherein said automatic document feed means comprises stacker means for stacking original documents, and original transport means for feeding the original documents from said stacker means to the exposure position and, after exposure, discharging the original documents to said stacker means, and wherein said designation means comprises detection means for detecting that all the original documents stacked on said stacker means have made a full circulation.

37. A sheet handling apparatus comprising:
image generating means capable of generating plural different original images;
image forming means for forming an image, on a sheet, corresponding to the original image generated by said image generating means;
stapling means for stapling the sheet subjected to image formation;
storage means for storing thus stapled sheets; and
control means for prohibiting the function of said image forming means during the function of said stapling means, and controlling the start of a next image forming operation according to the size of said sheets.

38. A sheet handling apparatus according to claim 37, wherein said control means is adapted to enable the start of the next image forming operation after the completion of said stapling operation when said sheets are of a small size.

39. A sheet handling apparatus according to claim 37, wherein said control means is adapted to enable the start of the next image forming operation after said sheet is stored in said storage means when said sheets are of a large size.

40. A sheet handling apparatus according to claim 37, wherein said image generating means is automatic document feed means for automatically feeding the original documents to an exposure position.

41. A sheet handling apparatus comprising:
image generating means capable of generating plural different original images;
image forming means for forming an image, on a sheet, corresponding to the original image generated by said image generating means;
selection means for selecting a sheet process mode;
storage means for stacking sheets subjected to image formation;
stapling means for stapling the sheets stacked in said storage means;
detection means for detecting presence or absence of sheets in said storage means; and
control means for controlling the start of a next image forming operation according to a next process mode, after the completion of a series of image forming operation and when said detecting means detects the presence of sheets, wherein said control means is adapted to prohibit the start of the next image forming operation if the next process mode includes a stapling process.

42. A sheet handling apparatus according to claim 41, further comprising means for informing of the presence of the sheet in said storage means.

43. A sheet handling apparatus according to claim 41, wherein said image generating means is automatic document feed means for automatically feeding original documents to an exposure position.

44. A sheet handling apparatus comprising:
image generating means capable of generating plural different original images;
image forming means for forming an image on a sheet corresponding to the original image generated by said image generating means;
storage means for stacking sheets subjected to image formation;
stapling means for stapling the sheets stored in said storage means;
detection means for detecting presence or absence of sheets in said storage means; and
prohibiting means for prohibiting the start of a next image forming operation after the completion of a series of image forming operation when said detection means detects the presence of sheets.

45. A sheet handling apparatus comprising:
document feed means for automatically feeding plural original documents stacked on a storage means to an exposure position, and, after exposure, discharging said original documents for return to said storage means;
image forming means for forming an image on a sheet corresponding to the image of said original document; and
setting means for setting a desired number of sheets to be subjected to image formation,
wherein said document feed means is operable in a first mode in which an original document is fed to the exposure position, the original document is discharged upon completion of one image forming operation, and the succeeding original document is fed to the exposure position, this sequential operation being repeated by the number of times corresponding to the number of sheets set by said setting means, and in a second mode in which an original document is fed to the exposure position, the original document is discharged upon completion of the number of image forming operations corresponding to the number of sheets set by said setting means, and the succeeding original document is fed to the exposure position; and
wherein said apparatus further comprises:
stapling means for stapling the sheets subjected to image formation;
selecting means for outputting a selection command for selection of stapling processing by said stapling means; and
control means for setting the operation mode of said document feed means to the first mode in accordance with the selection command from said selection means.

* * * * *

UNITED STATES PATENT AND TRADEMARK OFFICE

CERTIFICATE OF CORRECTION

PATENT NO. : 4,917,366

DATED : April 17, 1990

INVENTOR(S) : KOICHI MURAKAMI ET AL.

It is certified that error appears in the above-identified patent and that said Letters Patent is hereby corrected as shown below:

SHEET 6 OF 33

FIG. 7, "PLANGER" should read --PLUNGER--.

SHEET 10 OF 33

FIG. 12, "PLANGER" should read --PLUNGER--.

SHEET 12 OF 33

FIG. 14, "STOPER" should read --STOPPER--.

SHEET 13 OF 33

FIG. 15, "STOPER" should read --STOPPER--.

SHEET 19 OF 33

FIG. 18, "CLATCH" should read --CLUTCH--.

COLUMN 1

Line 31, "required" should read --requires--.
Line 42, "a" should be deleted.

COLUMN 2

Line 13, "number-and" should read --number and--.

COLUMN 3

Line 44, "(c);" should read --(C);--.

UNITED STATES PATENT AND TRADEMARK OFFICE

CERTIFICATE OF CORRECTION

PATENT NO. : 4,917,366

DATED : April 17, 1990

INVENTOR(S) : KOICHI MURAKAMI ET AL.

It is certified that error appears in the above-identified patent and that said Letters Patent is hereby corrected as shown below:

COLUMN 5

Line 46, "stopped by a" should be deleted.

COLUMN 6

Line 48, "stacker ode" should read --stacker mode--.

COLUMN 7

Line 40, "the-lower" should read --the lower--.

COLUMN 8

Line 46, "recording" should read --recordings--.

COLUMN 10

Line 68, "and-stopper" should read --and stopper--.

COLUMN 13

Line 18, "sheet" should read --sheets--.
Line 45, "said-tray" should read --said tray--.

COLUMN 14

Line 29, "is" should read --are--.
Line 53, "lateral" should read --laterally--.
Line 54, "instruction the" should read --instruction from the--.

UNITED STATES PATENT AND TRADEMARK OFFICE

CERTIFICATE OF CORRECTION

PATENT NO. : 4,917,366

DATED : April 17, 1990

INVENTOR(S) : KOICHI MURAKAMI ET AL.

It is certified that error appears in the above-identified patent and that said Letters Patent is hereby corrected as shown below:

COLUMN 15

Line 16, "according" should read --according to--.

COLUMN 16

Line 55, "interface (I/O)" should read --interface I/O--.
Line 64, "corresponds" should read --correspond--.

COLUMN 17

Line 29, "above-," should read --above,--.

COLUMN 18

Line 29, "as" should be deleted.

COLUMN 19

Line 61, "half-fold mold" should read --half-fold mode--.

COLUMN 20

Line 11, "twoside key 618" should read --two-side key 618--.

COLUMN 21

Line 61, "abovementioned" should read --above-mentioned--.
Line 67, "sheet" should read --sheets--.

UNITED STATES PATENT AND TRADEMARK OFFICE

CERTIFICATE OF CORRECTION

PATENT NO. : 4,917,366

DATED : April 17, 1990

INVENTOR(S) : KOICHI MURAKAMI ET AL.

It is certified that error appears in the above-identified patent and that said Letters Patent is hereby corrected as shown below:

COLUMN 23

Line 50, "discriminate" should read --to discriminate--.
Line 60, "the-latter" should read --the latter--.

COLUMN 25

Line 41, "speed" should read --speed.--.
Line 45, "completed" should read --completed.--.
Line 53, "omitted" should read --omitted.--.

COLUMN 26

Line 36, "discharged" should read --discharge--.
Line 46, "of" should read --or--.

COLUMN 27

Line 48, "detecting" should read --detection--.

COLUMN 28

Line 1, "claims" should read --claim--.
Line 12, "detecting" should read --detection--.

COLUMN 30

Line 37, "of number" should read --or number--.

COLUMN 31

Line 56, "operation" should read --operations--.

UNITED STATES PATENT AND TRADEMARK OFFICE

CERTIFICATE OF CORRECTION

PATENT NO. : 4,917,366

DATED : April 17, 1990

INVENTOR(S) : KOICHI MURAKAMI ET AL. Page 5 of 5

It is certified that error appears in the above-identified patent and that said Letters Patent is hereby corrected as shown below:

COLUMN 32

Line 22, "operation" should read --operations--.

Signed and Sealed this

Twelfth Day of May, 1992

*Attest:*

DOUGLAS B. COMER

*Attesting Officer*

*Acting Commissioner of Patents and Trademarks*